US007383004B2

(12) United States Patent
Yoshikawa

(10) Patent No.: US 7,383,004 B2
(45) Date of Patent: Jun. 3, 2008

(54) IMAGE FORMING APPARATUS

(75) Inventor: Tadanobu Yoshikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 221 days.

(21) Appl. No.: 11/302,421

(22) Filed: Dec. 14, 2005

(65) Prior Publication Data

US 2006/0140653 A1 Jun. 29, 2006

(30) Foreign Application Priority Data

Dec. 14, 2004 (JP) ..... 2004-362074

(51) Int. Cl.
*G03G 15/09* (2006.01)

(52) U.S. Cl. ..... 399/271; 399/343; 399/354

(58) Field of Classification Search ..... 399/44, 399/48, 50, 71, 168, 174–175, 241, 245, 399/249, 264, 270–271, 290–295, 315, 343–344, 399/348, 354

See application file for complete search history.

(56) References Cited

U.S. PATENT DOCUMENTS 5,822,651 A * 10/1998 Yim et al. ..... 399/66
6,128,461 A 10/2000 Yoshikawa ..... 399/350
6,421,512 B2 7/2002 Watanabe et al. ..... 399/149
6,560,417 B1 * 5/2003 Rodriguez ..... 399/27
6,744,994 B2 6/2004 Yoshikawa et al. ..... 399/44
6,807,384 B2 10/2004 Okubo et al. ..... 399/50
6,952,546 B2 10/2005 Yoshikawa ..... 399/129
7,099,598 B2 * 8/2006 Dougherty et al. ..... 399/27
2004/0175195 A1 * 9/2004 Kobashigawa ..... 399/44

FOREIGN PATENT DOCUMENTS

JP 2001-215798 8/2001
JP 2003-316202 11/2003

* cited by examiner

*Primary Examiner*—David M. Gray
*Assistant Examiner*—Geoffrey T Evans
(74) *Attorney, Agent, or Firm*—Fitzpatrick, Cella, Harper & Scinto

(57) ABSTRACT

A pulse-like DC voltage is applied from two power sources to transfer residual toner uniformizing means and toner charge amount control means, respectively, to expel transfer residual toner deposited on these means from these means onto a photosensitive drum. In a low humidity environment, the number of application of the DC voltage is increased so as to sufficiently expel the transfer residual toner because the transfer residual toner is less liable to be expelled even when the pulse-like DC voltage is applied to the above two means in the low humidity environment in which an absolute moisture content in atmosphere is small and electrical resistances at portions of a photosensitive drum contacting the above two means.

3 Claims, 16 Drawing Sheets

IMAGE FORMING APPARATUS

FIELD OF THE INVENTION AND RELATED ART

The present invention relates to a cleaner-less type image forming apparatus, i.e., such an image forming apparatus that transfer residual toner remaining on an image bearing member after a transfer step is removed from the image bearing member by a developing apparatus in accordance with a simultaneously developing and cleaning scheme.

FIG. 16 shows a cleaner-less type image forming apparatus described in Japanese Laid-Open Patent Application (JP-A) No. 2001-215798. Referring to FIG. 16, a photosensitive drum 1 rotationally driven in a direction of an indicated arrow R1 is electrically charged uniformly at a charging portion a by a charging roller 2 and subjected to exposure to light L at an exposure portion b by an exposure apparatus 3 to form an electrostatic latent image thereon. The electrostatic latent image is developed with toner to be deposited on the photosensitive drum at a developing portion c by a developing apparatus 4, thus forming a toner image.

The thus formed toner image on the photosensitive drum 1 is transferred onto a transfer material P such as paper at a transfer portion d by a transfer roller 5. The toner image transferred onto the transfer material P is fixed thereon by a fixing apparatus 6. On the other hand, toner (transfer residual toner) which has not been transferred onto the transfer material P during the toner image transfer and remaining on the surface of the photosensitive drum 1 is conveyed by the rotation of the photosensitive drum 1 and is recovered or collected into the developing apparatus 4, during a subsequent developing step, simultaneously with development.

In such a cleaner-less type image forming apparatus, however, in the case of using a contact charging member as a charging apparatus (the charging roller 2 in FIG. 16), a toner portion having a polarity opposite to a normal charging polarity (referred to as "polarity-reversed toner" of the transfer residual toner on the photosensitive drum 1 is deposited and accumulated on the surface of the charging roller 2 when the transfer residual toner passes through the charging portion a as a contact portion between the photosensitive drum 1 and the charging roller 2. As a result, there is a possibility that charging failure is caused to occur.

The polarity-reversed toner of the transfer residual toner is caused to occur due to such a phenomenon that a toner portion having a charging polarity which has been originally reversed to an opposite polarity is contained in toner as developer although an amount thereof is small or such a phenomenon that even toner having a normal charging polarity is caused to provide less amount of electric charge due to reversal of the charging polarity by the influence of transfer bias or peeling discharge or due to charge removal.

In other words, in the transfer residual toner, there are toner particles having the normal charging polarity, those having the opposite polarity (polarity-reversed toner), and those having a small amount of electric charge in mixture. Accordingly, it is considered that the polarity-reversed toner and the toner having the small charge amount in the transfer residual toner are deposited on the charging roller 2 when they pass through the charging portion a.

Further, in order to remove and recover the transfer residual toner on the photosensitive drum 1 by the developing apparatus 4, the charging polarity of the transfer residual toner, on the photosensitive drum 1, passing through the charging portion a and reading the developing portion c is required to be the normal charging polarity and the charge amount of the transfer residual toner is required to be such an amount of electric charge of toner that it can be recovered onto the photosensitive drum 1. The polarity-reversed toner and the toner having an inappropriate charge amount cannot be removed and recovered from the photosensitive drum 1 to the developing apparatus 4, thus causing a poor or defective image.

In the image forming apparatus shown in FIG. 16, between the transfer portion d and the charging portion a along the surface of photosensitive drum 1, a transfer residual toner uniformizing means 7 as an auxiliary charging member is disposed on an upstream side in a rotation direction of the photosensitive drum 1 and a toner charge amount control means 8 as an auxiliary charging member is disposed on a downstream side in the rotation direction.

The transfer residual toner uniformizing means 7 is a means for dispersing and distribution an image pattern of an image of the transfer residual toner remaining on the photosensitive drum 1 without being transferred at the transfer portion d to remove the image pattern. More specifically, the surface of the photosensitive drum 1 is rubbed with a rubbing member such as a brush to scrape or disturb the image pattern of the transfer residual toner so as to disperse or distribute the transfer residual toner on the surface of the photosensitive drum 1. The transfer residual toner uniformizing means 7 forms a contact portion e with the surface of the photosensitive drum 1.

By disposing the transfer residual toner uniformizing means 7, it becomes possible to stably perform a process of electrically charging the transfer residual toner on the photosensitive drum 1 to a normal charging polarity by the toner charge amount control means 8 in a subsequent step, so that prevention of deposition of the transfer residual toner on the charging roller 2 is effectively performed. Further, a latent image pattern of the transfer residual toner on the photosensitive drum 1 is also erased at the same time, so that it is possible to prevent an occurrence of a ghost image by the latent image pattern of the transfer residual toner.

More specifically, e.g., in the case of an image such as a vertical pattern image bearing less transferred at the transfer portion d, an amount of the transfer residual toner on the image bearing member is locally increased. In such a case, when the transfer residual toner uniformizing means 7 is omitted, the transfer residual toner is conveyed to the toner charge amount control means 8 without being dispersed uniformly. For this reason, the transfer residual toner cannot be sufficiently processed by the toner charge amount control means 8 so as to be electrically charged to the normal charging polarity, thus being deposited on the charging roller 2. When the transfer residual toner is deposited on the charging roller 2 to contaminate the charging roller 2, charging failure (poor charging) is caused to occur in some cases. Further, a ghost image can be caused to occur on a subsequent image by a pattern of the transfer residual toner i.e., a latent image pattern remaining on the photosensitive drum 1 after the transfer step.

The pattern of the transfer residual toner on the photosensitive drum 1 conveyed to the toner charge amount control means 8 is sufficiently removed by providing the transfer residual toner uniformizing means 7, so that it becomes possible to process the transfer residual toner so as to be electrically charged by the toner charge amount control means 8 to have an appropriate charge amount suitable for recovery by the developing apparatus 4. As a result, it is possible to prevent the deposition of the transfer residual toner on the charging roller 2 and effectively recover the transfer residual toner by the developing apparatus 4. Accordingly, a stable image free from charging failure, ghost, fog, and the like can be formed.

However, in the case where a printing operation of an image having a high print ratio, such as a photographic image, is performed, a part of the transfer residual toner is deposited and accumulated at the contact portions e and f of the transfer residual toner uniformizing means 7 and the toner charge amount control means 8 with the photosensitive drum 1. As a result, electrical resistances of the contact portions are increased, thus causing a lowering in function of the transfer residual toner uniformizing means 7 and the toner charge amount control means 7. As a result, the pattern removal of the transfer residual toner and the charging process of the transfer residual toner become insufficient, thus resulting in problems of occurrences of charging failure, ghost, fog, etc.

For this reason, even in the case of performing the printing operation of the image having a high print ratio, it is necessary to periodically expel the toner accumulated in the transfer residual toner uniformizing means 7 and the toner charge amount control means 8 in order to maintain the functions of the transfer residual toner uniformizing means 7 and the toner charge amount control means 8.

In JP-A No. 2003-316202, such a control that an operation in which a voltage applied to a contact charging apparatus is turned off and at the same time, voltages applied to a transfer residual toner uniformizing means 7 and a toner charge amount control means 8 are switched between on and off states in a pulse-like manner is repeated a predetermined number of times at a preliminarily determined timing, such as at start up of image forming apparatus, at the time of an interval between printing operations, or at the time of completion of the printing operations, has been described.

By performing the above-described expulsion control at the predetermined timing, even in the case where a large amount of transfer residual toner is accumulated in the transfer residual toner uniformizing means 7 and the toner charge amount control means 8, such as a case of performing the printing operation of an image having a high print ratio, it becomes possible to expel the toner accumulated in the transfer residual toner uniformizing means 7 and the toner charge amount control means 8 to prevent the lowering in function of the transfer residual toner uniformizing means 7 and the toner charge amount control means 8. As a result, it is possible to prevent image failure such as charging failure, ghost, fog, etc. Incidentally, power sources S1 to S5 shown in FIG. 16 are power sources for applying voltages (biases) to members connected with these power sources, respectively.

However, in the case where an operation environment of the above-described image forming apparatus is changed variously, more specifically, when cases where an absolute moisture content in an operation ambient environment is high and low are compared, electrical resistances of the transfer residual toner uniformizing means 7 itself and the toner charge amount control means 8 itself and the charge amounts of the transfer residual toner accumulated in the transfer residual toner uniformizing means 7 and the toner charge amount control means 8 are largely different from each other. Particularly; in the low absolute moisture content environment, even in the case where the above described expulsion control is performed, it is difficult to sufficiently expel or discharge the toner accumulated in the transfer residual toner uniformizing means 7 and the toner charge amount control means 8.

Further, in the case of using the above described image forming apparatus for a long period of time, not only the toner but also paper powder and/or an external additive added in the toner such as inorganic particles are accumulated in the transfer residual toner uniformizing means 7 and the toner charge amount control means 8 or members themselves used for the transfer residual toner uniformizing means 7 and the toner charge amount control means 8 are increased in electrical resistance. As a result, even when the above described expulsion control is performed, it is difficult to sufficiently expel the toner accumulated in the transfer residual toner uniformizing means 7 and the toner charge amount control means 8 therefrom.

Further, in the case where a continuous printing operation of an image having a very high print ratio is performed, there is a possibility that a large amount of transfer residual toner is accumulated in the transfer residual toner uniformizing means 7 and the toner charge amount control means 8 before the preliminarily determined expulsion control is performed. In the case where the large amount of transfer residual toner is accumulated, electrical resistances of the contact portions e and f of the transfer residual toner uniformizing means 7 and the toner charge amount control means 8 with the photosensitive drum 1 are increased to cause the lowering in function of the transfer residual toner uniformizing means 7 and the toner charge amount control means 8 . As a result, the charging process of the transfer residual toner is insufficient, thus resulting in problems of occurrences of charging failure, ghost, fog, etc.

SUMMARY OF THE INVENTION

An object of the present invention is to provide an image forming apparatus capable of expelling or discharging transfer residual toner deposited on an auxiliary charging member irrespective of an operation environment and an operation time of the image forming apparatus, and a print ratio of an image.

Another object of the present invention is to provide an image forming apparatus capable of forming a good image free from image failure such as charging failure, ghost, fog, and the like.

According to an aspect of the present invention, there is provided an image forming apparatus, comprising:

an image bearing member;

a contact charging member, disposed in contact with a surface of the image bearing member; for electrically charging the image bearing member;

exposure means for exposing the surface of the image bearing member, after being electrically charged, to light to form an electrostatic latent image;

developing means for developing the electrostatic latent image with toner to form a toner image and recovering toner remaining on the image bearing member;

transfer means for transferring the toner image from the image bearing member onto another member;

an auxiliary charging member, for processing the toner remaining on the image bearing member, disposed downstream from the transfer means and upstream from the contact charging member in a movement direction of the surface of the image bearing member;

voltage application means for applying a pulse-like direct-current voltage to the auxiliary charging member so as to expel the toner deposited on the auxiliary charging member from the auxiliary charging member onto the image bearing member;

control means for controlling the voltage application means; and an environmental sensor for detecting an ambient environment in which the image forming apparatus is set;

wherein the control means changes the number of times the pulse-like direct-current voltage is applied from the voltage application means to the auxiliary charging member on the basis of a detection result of the environmental sensor.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
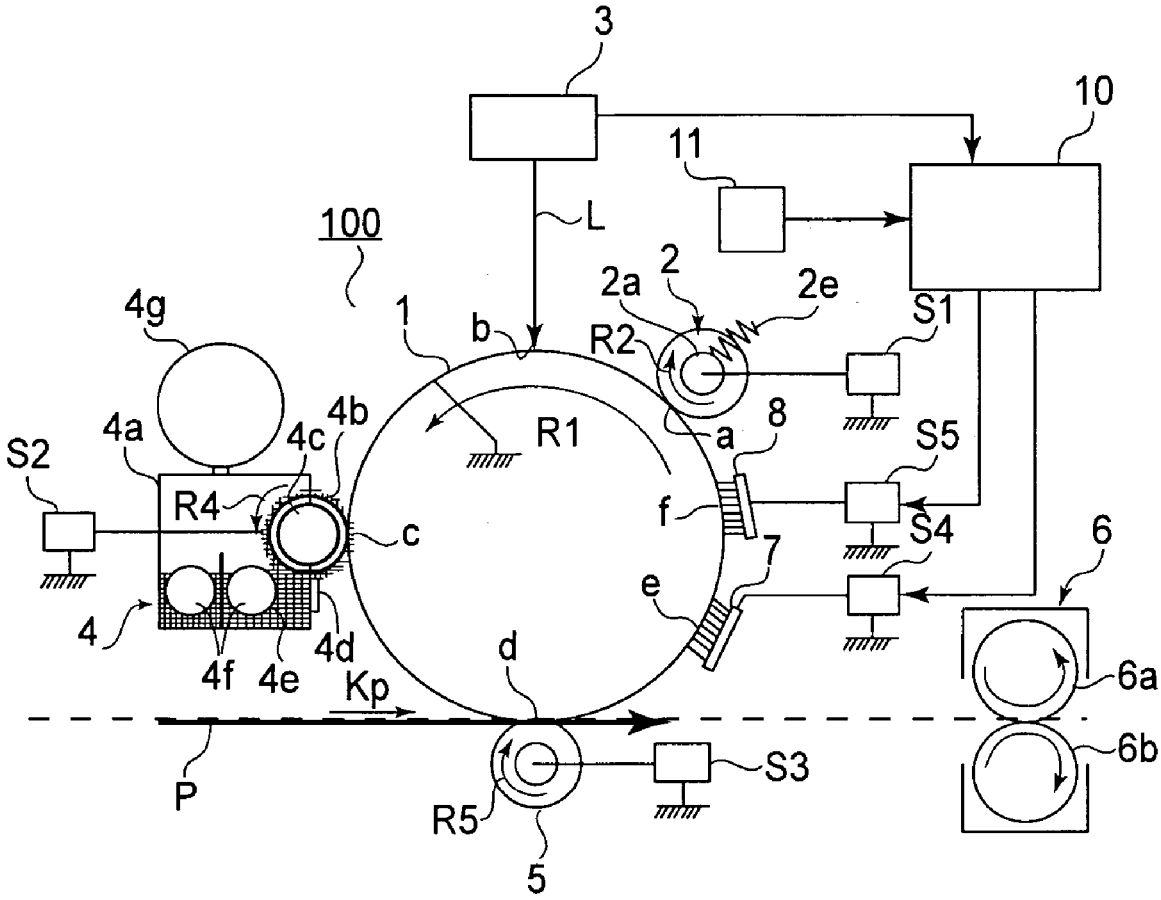
FIG. 1 is a schematic structural view of an image forming apparatus according to the present invention.

Hereinbelow, embodiments of the present invention will be described with reference to the drawings. In the drawings, members or means represented by the same reference numerals have the same constitutions or functions, so that repetitive explanations thereof are appropriately omitted.

Embodiment 1

FIG. 1 shows an image forming apparatus 100 according to the present invention. The image forming apparatus 100 shown in FIG. 1 is a laser beam printer in which a contact charging scheme, a reversed development scheme, and a cleaner-less scheme are adopted. FIG. 1 is a cross-sectional view for schematically illustrating a general structure of this laser beam printer (image forming apparatus).

(1) General Structure of Entire Image Forming Apparatus (a) Photosensitive Drum (Image Forming Member)

The image forming apparatus 100 shown in FIG. 1 includes a drum-like electrophotographic photosensitive member (hereinafter, referred to as a "photosensitive drum") 1. This photosensitive drum 1 is formed of negative chargeable organic photoconductor (OPC) in another diameter of 60 mm and is rotationally driven about a center shaft (axis) by drive means (not shown) at a process speed (peripheral speed) of 100 mm/sec in a direction of an indicated arrow R1 (counterclockwise direction in FIG. 1).

Figure 2:
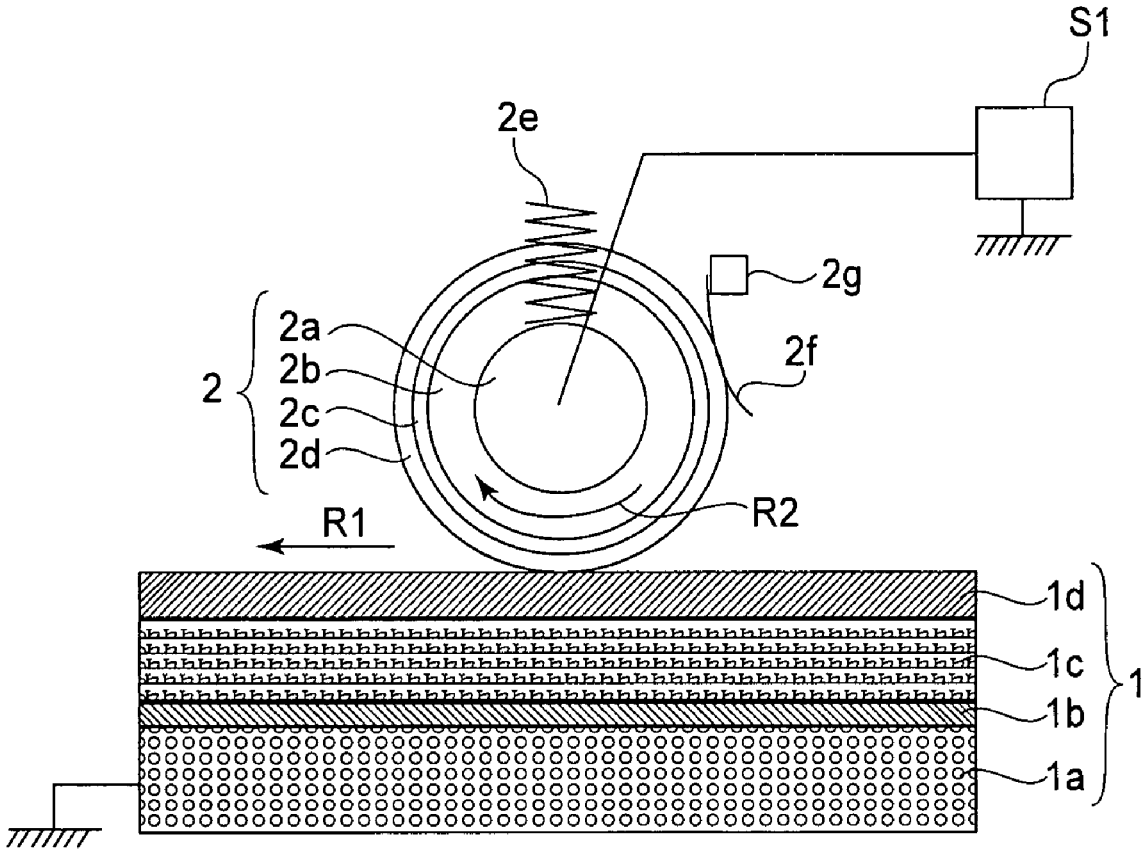
FIG. 2 is a schematic view showing a layer structure of a photosensitive drum and a layer structure of a charging roller of the image forming apparatus.

FIG. 2 schematically illustrates a layer structure of the photosensitive drum 1. The photosensitive drum 1 includes, as shown in FIG. 2, an aluminum cylinder (electroconductive drum support) 1*a*; an undercoat layer 1*b* for suppressing light interference and improving an adhesiveness to an overlying layer, disposed on an outer peripheral surface of the cylinder 1*a*; a photocharge generation layer 1*c* disposed on the undercoat layer 1*b*; and a charge transport layer 1*d* disposed on the photocharge generation layer 1*c*. The electroconductive drum support 1*a* is grounded.

As shown in FIG. 1, around the photosensitive drum 1, a charge roller (contact charging member) 2, an exposure apparatus (exposure means) 3, a developing apparatus (developing means) 4, and a transfer roller (transfer means) 5 are disposed substantially in this order in a rotation direction of the photosensitive drum 1. Further, a fixing apparatus (fixing means) 6 is disposed downstream from the transfer roller 5 in a conveyance direction (indicated by an arrow Kp) of a recording material P.

(b) Charge Roller (Charging Means) 2

The charge roller 2 is disposed in parallel nd contact with the photosensitive drum 1.

The charge roller 2 is rotationally supported by an unshown pair of bearing members, at end portions of its metallic core 2*a*, and these bearing members are kept pressured toward the photosensitive drum 1 by a pair of compression coil springs 2*e* so that its peripheral surface is kept pressed upon the peripheral surface of the photosensitive drum 1 at a predetermined pressing force. The contact nip between the photoconductive drum 1 and charge roller 2 constitutes the charging portion a (charging nip). The charge roller 2 is rotated in a direction of an arrow R2 by the rotation in the arrow R1 direction of the photoconductive drum 1.

To the metallic core 2*a* of the charge roller 2, a charge bias voltage, which satisfies predetermined requirements, is applied from an electrical power source S1, so that as the photosensitive drum 1 is rotated, the peripheral surface of the photosensitive drum 1 is electrically uniformly charged to predetermined polarity and potential level. In this embodiment, the charge bias voltage applied to the charge roller 2 is an oscillating voltage, that is, a combination of DC (Vdc) and AC (Vac) voltages. More specifically, it is the combination of DC voltage (Vdc) of −500 V, and AC voltage (Vac), which is 1 kHz and 1.5 kV in frequency f and peak-to-peak voltage Vpp, respectively, and has a sinusoidal waveform. By application of this charge bias voltage to the charge roller 2, the peripheral surface of the photosensitive drum 1 is uniformly charged to −500 V (dark part potential Vd).

Referring to FIG. 2, which is a schematic drawing for showing the layer structure of the charge roller 2, the charge roller 2 has a length of 320 mm in a lengthwise direction, and comprises the aforementioned metallic core 2*a* (supporting member, and three layers, that is, an undercoat layer 2*b*, an intermediary layer 2*c*, and a surface layer 2*d*, which are placed in layers on the peripheral surface of the metallic core 2*a*, in this order. The undercoat layer 2*b* is for reducing the charging noises, and is formed of foamed substance such as sponge. The surface layer 2*d* is a protective layer provided for preventing electrical leak occurring when the peripheral surface of the photoconductive drum 1 has defects such as pin holes.

More specifically, the specification of the charge roller 2 in this embodiment is as follows:

a. metallic core 2*a*: a piece of stainless steel rod with a diameter of 6 mm;

b. undercoat layer 2*b*: formed of foamed EPDM in which carbon black has been dispersed; 0.5 in specific gravity; $10^2$-$10^9$ ohm·cm in volume resistivity; 3.0 mm in thickness; and 320 mm in length;

c: intermediary layer 2*c*: formed of NBR in which carbon black has been dispersed; $10^2$-$10^5$ ohm·cm in volume resistivity; and about 700 μm in thickness; and d. surface layer 2*d*: formed of Toresin resin a fluorinated compound, in which tin oxide and carbon black have been dispersed; $10^7$-$10^{10}$ ohm·cm in volume resistivity; 1.5 μm in surface roughness (10 point average surface roughness Rz in JIS); and 10 μm in thickness.

As shown in FIG. 2, a reference numeral 2*f* stands for a charge roller cleaning member which is abutted against the surface of the charge roller 2. In this embodiment, the charge roller cleaning member is a 25 μm-thick flexible cleaning film. This cleaning film 2*f* is fixed, at one of its long edges, to a supporting member 2*g* which oscillates a predetermined distance in the direction also parallel to the longitudinal direction of the charge roller 2. Further, the cleaning film 2*f* is positioned so that its portion adjacent to its free edge, that is, the edge by which it is fixed to the supporting member 2, forms a contact nip against the peripheral surface of the charge roller 2.

The supporting member 2*g* is driven by a driving motor (not shown) of the image forming apparatus 100 through a gear train so that it is oscillated by the predetermined distance in its longitudinal direction. As a result, the surface layer 2*d* of the charge roller 2 is rubbed by the cleaning film 2*f*. By this action of the cleaning film 2*f*, the contaminants (microscopic toner particles, additives, and the like) adhering to the surface layer 2*d* are removed.

(c) Exposure Apparatus (Exposure Means) 3

By the exposure apparatus 3 as an information writing means, an electrostatic latent image is formed on the peripheral surface of the photosensitive drum 1 electrically charged by the above described charge roller 2. In this embodiment, the exposure apparatus 3 is a laser beam scanner employing a semiconductor laser. The laser beam scanner (exposure apparatus) 3 scans (exposes) the uniformly charged peripheral surface of the photosensitive drum 1 with a scanning laser beam L which it projects while modulating the laser beam L with the image formation signals sent to the image forming apparatus from an unshown host such as an image reading apparatus. This scanning (exposing) is done at an exposing portion (exposing position) b. As the result of the scanning of the uniformly charged peripheral surface of the rotating photosensitive drum 1 by this laser beam L, the positions of the peripheral surface of the photosensitive drum 1 illuminated by the laser beam L are reduced in potential level, sequentially effecting an electrostatic latent image in accordance with the image formation information written on the peripheral surface of the photoconductive drum 1 by the scanning laser beam L.

(d) Developing Apparatus (Developing Means) 4

The developing apparatus 4 shown in FIG. 1 is a means for visualizing (developing) the electrostatic latent image on the photosensitive drum 1 with toner by supplying developer (toner) to the electrostatic latent image. In this embodiment, a reversal developing apparatus employing a two-component magnetic brush developing method is used.

The developing apparatus 4 includes a developer container 4*a*, a developing sleeve 4*b*, a magnet roller 4*c*, a developer coating blade 4*d*, developer stirring members 4*f*, and a toner hopper 4*g*. THe developer container contains developer 4*e*. The developing sleeve 4*b* is rotatably disposed at an opening of the developer container 4*a* with its peripheral surface partially exposed from the developer container 4*a*. Inside the developing sleeve 4*b*, the magnetic roller 4*c* is stationarily fixed. The developer coating blade 4*d* is used for regulating a layer thickness of the developer carried on the developing sleeve 4*b*. The developer stirring members 4*f* are positioned in the bottom portion of the developer container 4*a* so as to convey and stir the developer 4*e* in the developer container. The toner hopper 4*g* is disposed above the developer container 4*a* and contains toner to be supplied to the developer container 4*a*.

In this embodiment, a two-component developer is used as the developer 4*e*. The two-component developer is a mixture of toner and magnetic carrier, and is stirred by the developer stirring members 4*f*. In this embodiment, the electrical resistance of the magnetic carrier is approximately $10^{13}$ ohm·cm, and its particle size is about 40 μm. The toner is negatively charged by the friction between the toner and magnetic carrier.

The developing sleeve 4*b* is disposed in parallel to the photoconductive drum 1 so that the shortest distance (S-D gap) between the peripheral surfaces of the developing sleeve 4*b* and photosensitive drum 1 is maintained at 350 μm. A portion where the developing sleeve 4*b* and photosensitive drum 1 are disposed opposite to each other is a developing portion (developing position) c. The developing sleeve 4*b* is rotationally driven in such a direction that its peripheral surface moves in a direction (indicated by an arrow R4) opposite from the movement direction (arrow R1 direction) of the peripheral surface of the photosensitive drum 1, at the developing portion c. A part of the two-component developer 4*e* in the developer container 4*a* is adsorbed and held to the peripheral surface of the developing sleeve 4*b* by the magnetic force of the magnetic roller 4*c*. The held developer 4*e* is conveyed by the rotation of the developing sleeve 4*b*, and its thickness is reduced by the developer coating blade 4*d* to a predetermined one to come into contact with the peripheral surface of the photosensitive drum 1 and properly rubs the peripheral surface of the photosensitive drum 1, at the developing portion c. To the developing sleeve 4*b*, a predetermined developing bias voltage is applied from an electrical power source S2. In this embodiment, the developing bias voltage applied to the developing sleeve 4*b* is an oscillating voltage, that is, a combination of DC (Vdc) and AC (Vac) voltages. More specifically, it is the combination of DC voltage: −350 V, and AC voltage, which is 8.0 kHz and 1.8 kV in frequency f and peak-to-peak voltage pp, respectively, and has a rectangular waveform.

Through the process described above, the two-component developer 4*e* contained in the developer container 4*a* is coated in a thin layer on the peripheral surface of the rotating developing sleeve 4*b*, and is conveyed to the developing portion c, at which the toner portion of the developer 4*e* is selectively adhered to the portions of the peripheral surface of the photosensitive drum 1 corresponding to the pattern of the electrostatic latent image, by the electrical field generated by the development bias voltage. As a result, the electrostatic latent image is developed into a toner image. In this embodiment, the toner adheres to the exposed light portions of the peripheral surface of the photosensitive drum 1, so that the electrostatic latent image is developed in reverse.

As the developing sleeve 4*b* is further rotated, the developer 4*e* on the developing sleeve 4*b*, which passed through the developing portion c, is conveyed back into the developer pocket in the developer container 4*a*.

In order to keep the toner concentration of the developer 4*e* in the developer container 4*a* within a predetermined range, the toner concentration of the developer 4*e* in the developer container 4*a* is detected by, for example, an optical toner concentration sensor (not shown), and the toner hopper 4*g* is driven in response to the toner concentration information detected by the sensor, so that the toner within the toner hopper 4*g* is supplied to the developer 4*e* within the developer container 4*a*. After being supplied to the developer 4*e*, the toner in the developer 4*e* is stirred by the stirring members 4*f*.

(e) Transfer Roller 5 and Fixing Apparatus 6

The transfer roller 5 is kept pressed upon the photosensitive drum 1 at a predetermined pressing force, forming a compression nip against the peripheral surface of the photosensitive drum 1. This compression nip constitutes the transfer portion d. To this transfer portion d, transfer material P (e.g., paper, transparent film) is delivered from an unshown sheet feeding mechanism at a predetermined control timing.

As the transfer material P is delivered to the transfer station d, it is nipped between the peripheral surfaces of the photosensitive drum 1 and transfer roller 5, and is conveyed further while remaining nipped.

While the transfer material P is conveyed through the transfer portion d, being nipped by the peripheral surfaces of the photosensitive drum 1 and transfer roller 5, a transfer bias voltage with the positive polarity, which is +2 kV in this embodiment and is opposite to the negative (normal) polarity of the toner, is applied to the transfer roller 5 from an electrical power source S3. As a result, the toner image on the peripheral surface of the photosensitive drum 1 is transferred, electrostatically and sequentially, onto the surface of the transfer material P.

After receiving the toner image while being passed through the transfer portion d, the transfer material P is separated from the peripheral surface of the photosensitive drum 1, and is conveyed to the fixing apparatus 6. The fixing apparatus 6 includes a fixation roller 6*a* containing therein a heater (not shown) and a pressure roller 6*b* pressed against the fixation roller 6*a*. The transfer material P is conveyed through a compression portion (fixing nip portion) between the fixing and pressure rollers under heating and pressure application, so that the toner image is fixed on the transfer material P. In the above described manner, formation of an image on one surface of one sheet of the transfer material P is completed.

(2) Cleaner-Less System

The image forming apparatus 100 in this embodiment is of a cleaner-less type. In other words, it is not equipped with a cleaning apparatus dedicated to the removal of the residual toner, that is, a small amount of toner remaining on the peripheral surface of the photosensitive drum 1 after the transfer of the toner image onto the recording material P. Thus, after the transfer, the residual toner on the peripheral surface of the photosensitive drum 1 is conveyed farther by the rotation of the photosensitive drum 1 through the charging portion a and exposing portion b, and to the development portion c, in which they are removed (recovered) by the developing apparatus 4 at the same time as the development process is carried out by the developing apparatus (cleaner-less system).

In this embodiment, the developing sleeve 4*b* of the developing apparatus 4 is rotated in such a direction that at the development portion c, the peripheral surface of the developing sleeve 4*b* rotationally moves in the direction of the arrow R4 opposite to the peripheral surface of the photosensitive drum 1, as described above. Rotating the developing sleeve 4*b* in this manner is advantageous for the recovery of the residual toner on the peripheral surface of the photosensitive drum 1.

Since the residual toner on the peripheral surface of the photosensitive drum 1 goes through the exposing portion b, the peripheral surface of the photosensitive drum 1 is exposed with the presence of the residual toner on the peripheral surface. However, the amount of the residual toner is very small, and therefore, the presence of the residual toner does not greatly affect the exposing process, except for the following.

As described hereinbefore, in terms of polarity, the transfer residual toner is the mixture of the normally charged (negatively charged) toner and reversely charged (positively charged) toner (polarity-reversed toner). Further, some of the charged toner has an insufficient amount of electrical charge. Thus, when the residual toner passes through the charging portion a, the polarity-reversed toner and the insufficiently charged toner are deposited on the charge roller 2, thus contaminating the charge roller 2 beyond the tolerable range to cause charging failure.

Further, in order to effectively perform simultaneous developing and cleaning of the transfer residual toner on the peripheral surface of the photosensitive drum 1 by the developing apparatus 4, it is necessary that the transfer residual toner on the photosensitive drum 1, which are being conveyed to the development portion c, is normal in charge polarity, and that the amount of the electric charge of the transfer residual toner is proper for an electrostatic latent image on the photosensitive drum 1 to be satisfactorily developed by the developing apparatus. The polarity-reversely toner and the toner with an unsatisfactory amount of electrical charge cannot be removed (recovered) from the photosensitive drum 1 by the developing apparatus 4, thus being liable to cause image defects.

For this reason, the transfer residual toner uniformizing means 7 (auxiliary charging member) for uniforming the transfer residual toner on the photosensitive drum 1 is disposed at a position downstream from the transfer portion d in the rotation direction of the photosensitive drum 1, and the toner charge amount control means (auxiliary charging member) 8 for electrically uniformly charging the transfer residual toner to a normal charge polarity at a position downstream from the transfer residual toner uniformizing means 7 and upstream from the charging portion a in the rotation direction of the photosensitive drum.

Generally, the transfer residual toner remaining on the photosensitive drum 1 without being transferred onto the transfer material P at the transfer portion d contains the polarity-reversed toner and insufficiently charged toner in mixture, so that the prevention of deposition of the transfer residual toner on the charge roller 2 is effectively performed by once charge-removing the transfer residual toner by the transfer residual toner uniformizing means 7 and electrically charging the transfer residual toner to a normal charge polarity by the toner charge amount control means 8. Further, removal and recovery of the transfer residual toner by the developing apparatus 4 can be performed sufficiently, so that it is possible to prevent an occurrence of ghost image of the transfer residual toner image pattern with reliability.

In this embodiment, the transfer residual toner uniformizing means 7 and the toner charge amount control means 8 are brush-like members with an appropriate electroconductivity, and are disposed so that their brush portions contact the surface of the photosensitive drum 1, respectively. The brush-like member is prepared by dispersing a resistance-adjusting agent such as carbon black or metal powder is fibers of rayon, acryl resin, polyester, or the like to have an adjusted electrical resistance. In this embodiment, the brush-like member may preferably formed of fibers each having a thickness (fineness) of not more than 30 denir and has a planted density of 7750-77500 fibers/cm$^2$ ($5\times10^4$-$5\times10^5$ fibers/inch$^2$). A specific brush-like member used in this embodiment has a thickness of 6 denir per fiber, a planted density of 15500 fibers/cm$^2$ ($10\times10^4$ fibers/inch$^2$), a length from fixed end to free end of 5 mm, and an electrical resistance of $5\times10^4$ ohm·cm.

Further, as shown in FIG. 1, a contact portion e is formed between the transfer residual toner uniformizing means 7 and the photosensitive drum 1 and a contact portion is formed between the toner charge amount control means 8 and the photosensitive drum 1. Each of the contact portions e and f has a width in a sub-scanning direction (of the transfer residual toner uniformizing means 7 or the toner charge amount control means 8) of 5 mm. Further, each of the transfer residual toner uniformizing means 7 and the toner charge amount control means 8 is pressed against the surface of the photosensitive drum 1 in a penetration depth of 1 mm.

To the transfer residual toner uniformizing means 4, a positive drive-current (DV) voltage is applied from a power source S4 as a voltage application means and to the toner charge amount control means 8, a negative DC voltage is applied from a power source S5 as a voltage application means. More specifically, a voltage of +400 V is applied to the transfer residual toner uniformizing means 7 and a voltage of −800 V is applied to the toner charge amount control means 8.

The transfer residual toner remaining on the photosensitive drum 1 at the transfer portion d after the toner image is transferred onto the transfer material P is conveyed to the contact portion e between the transfer residual toner uniformizing means 7 and the photosensitive drum 1, where the electric charge of the transfer residual toner is uniformized by the transfer residual toner uniformizing means 7 so as to be about 0 μC/g. Then, the transfer residual toner uniformized by the transfer residual toner uniformizing means 7 on the surface of the photosensitive drum 1 is conveyed to the contact portion f between the toner charge amount control means 8 and the photosensitive drum 1, where the charge polarity of the transfer residual toner is controlled by the toner charge amount control means 8 so as to be a uniformly negative polarity as a normal charge polarity.

By uniformizing the charge polarity of the transfer residual toner so as to be the normal negative polarity, a mirror force of the transfer residual toner acting on the photosensitive drum 1 is increased when the charging process of the surface of the photosensitive drum 1 is performed through the transfer residual toner at the contact portion a between the charge roller 2 and the photosensitive drum 1, thus preventing deposition of the transfer residual toner on the charge roller 2. For this reason, the amount of electric charge imparted to the charge roller 2 by the toner charge amount control means 8 is required to be not less than about two times the toner charge amount at the time of the developing.

Next, the recovery of the transfer residual toner in the developing process will be described.

The developing apparatus 4, as described above, cleans the photosensitive drum surface and recovers the transfer residual toner at the same time with the development (cleaner-less scheme).

In order to recover the transfer residual toner on the photosensitive drum 1 into the developing apparatus 4, the charge amount of the transfer residual toner is required to be substantially equal to that during the development. However, as described above, in order to prevent the toner deposition on the charge roller 2, the charge amount of the transfer residual toner is increased up to about two times that during the development by the toner charge amount control means 8. For this reason, it is necessary to effect charge removal in order to recover the transfer residual toner in the print ratio 4.

To the charge roller 2, an AC voltage (frequency: 1 kHz, peak-to-peak voltage Vpp: 1.5 kV) is applied in order to charge-processing the photosensitive drum 1 surface, so that the transfer residual toner on the photosensitive drum 1 is charge-removed by the AC voltage. Accordingly, the charge amount of the transfer residual toner after passing through the charging portion a is substantially equal to that during the development. FOr these reasons, in the developing process, the transfer residual toner deposited on a portion (non-image portion) on which the toner remaining on the photosensitive drum 1 should not be deposited, is recovered into the developing apparatus 4.

As described above, the charge amount of the transfer residual toner on the photosensitive drum 1 conveyed from the transfer portion d to the charging portion a is controlled so that the transfer residual toner is charge-processed uniformly to the negative (normal) polarity by the toner charge amount control means 8, whereby the deposition of the transfer residual toner on the charge roller 2 is prevented. Further, the charge amount of the transfer residual toner charge-processed to the negative (normal) polarity by the toner charge amount control means 8 is controlled to be an appropriate charge amount for developing the electrostatic latent image on the photosensitive drum 1 by the developing apparatus 4, whereby the recovery of the transfer residual toner by the developing apparatus 4 is efficiently performed.

(3) Expulsion Control of Auxiliary Charging Member

In the case where a continuous printing operation of an image having a high print ratio such as a photographic image is performed, a large amount of transfer residual toner is deposited and accumulated at the contact portions e and f between the photosensitive drum 1 and the transfer residual toner uniformizing means 7 and between the photosensitive drum 1 and the toner charge amount control means 8, respectively. As a result, electrical resistances of the transfer residual toner uniformizing means 7 and the toner charge amount control means 8 are increased to cause lowering in function of the transfer residual toner uniformizing means 7 and the toner charge amount control means 8, so that removal of the pattern of the transfer residual toner and the charge-process of the transfer residual toner become insufficient, thus causing the deposition of toner on the charge roller 2 and recovery failure by the developing apparatus 4.

Figure 3:
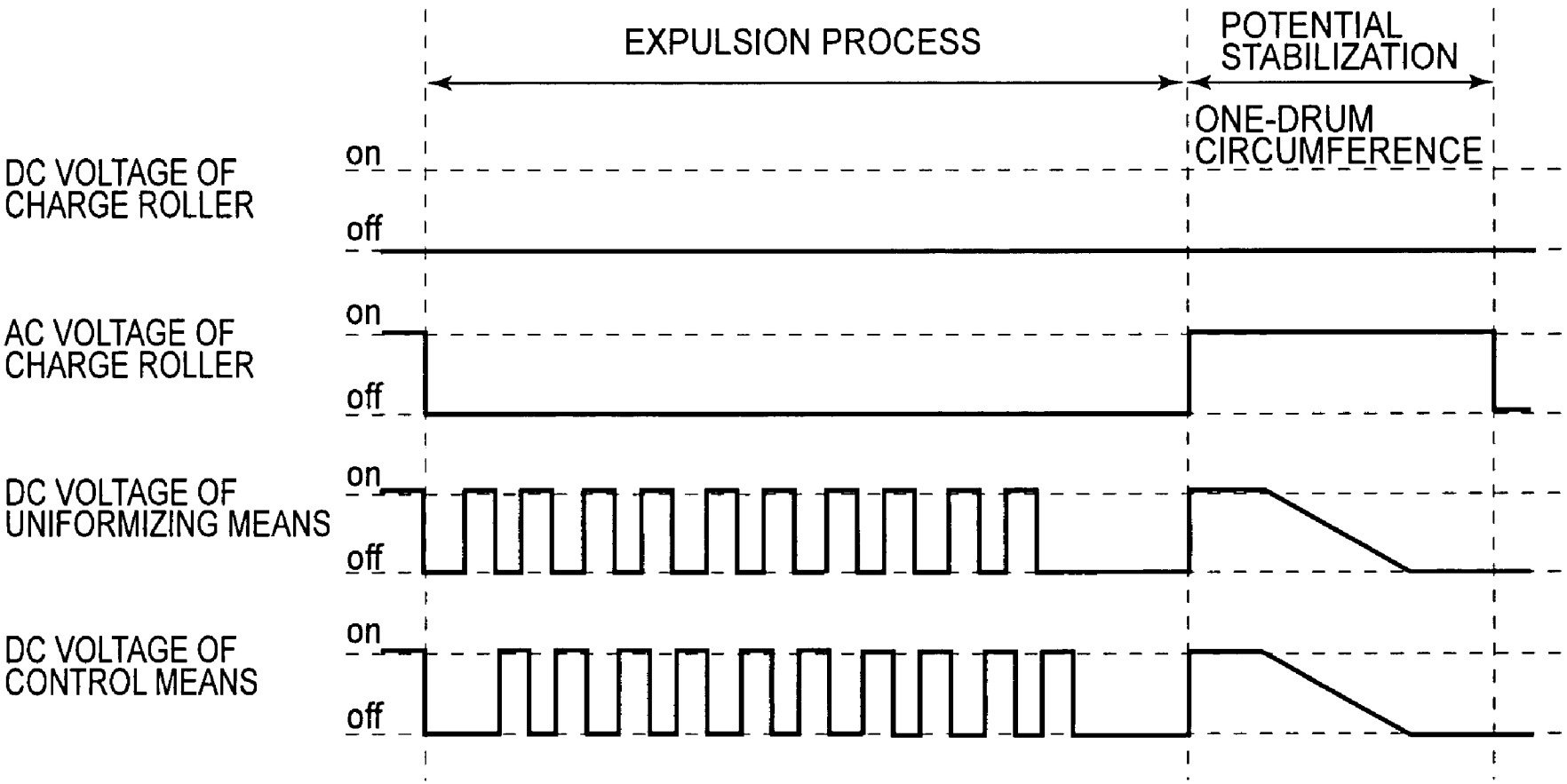
FIG. 3 is a timing chart of expulsion control of transfer residual toner in a transfer residual toner uniformizing means and a toner charge amount control means.

FIG. 3 is a timing chart of expulsion control for expelling the toner accumulated in the transfer residual toner uniformizing means 7 and the toner charge amount control means 8 in this embodiment. At a timing other than the image forming operation, expulsion of the toner accumulated in the transfer residual toner uniformizing means 7 and the toner charge amount control means 8 is performed by repeating such a switching operation of switching ON/OFF states of a DC voltage applied to the transfer residual toner uniformizing means 7 and the toner charge amount control means 8 in a pulse-like manner, i.e., repetition of pulse voltage application. In this case, the switching operation is repeated 10 times. Voltages applied to the transfer residual toner uniformizing means 7 and the toner charge amount control means 8 are +300 V and −300 V, respectively, which are lower than discharge start voltages, of members constituting the transfer residual toner uniformizing means 7 and the toner charge amount control means 8, with respect to the photosensitive drum 1. One pulse voltage application operation is performed in a period consisting of an ON time of 50 msec and an OFF time of 100 msec. The timing for periodically performing the expulsion control in this embodiment is the time of turning on power to the image forming apparatus, the time of performing post-rotation operation after completion of the image formation, and an interval between image forming operations on 100-th sheet and 101-th sheet in the case where the continuous image forming operation of the transfer material P on not less than 100 sheets is performed.

Figure 4:
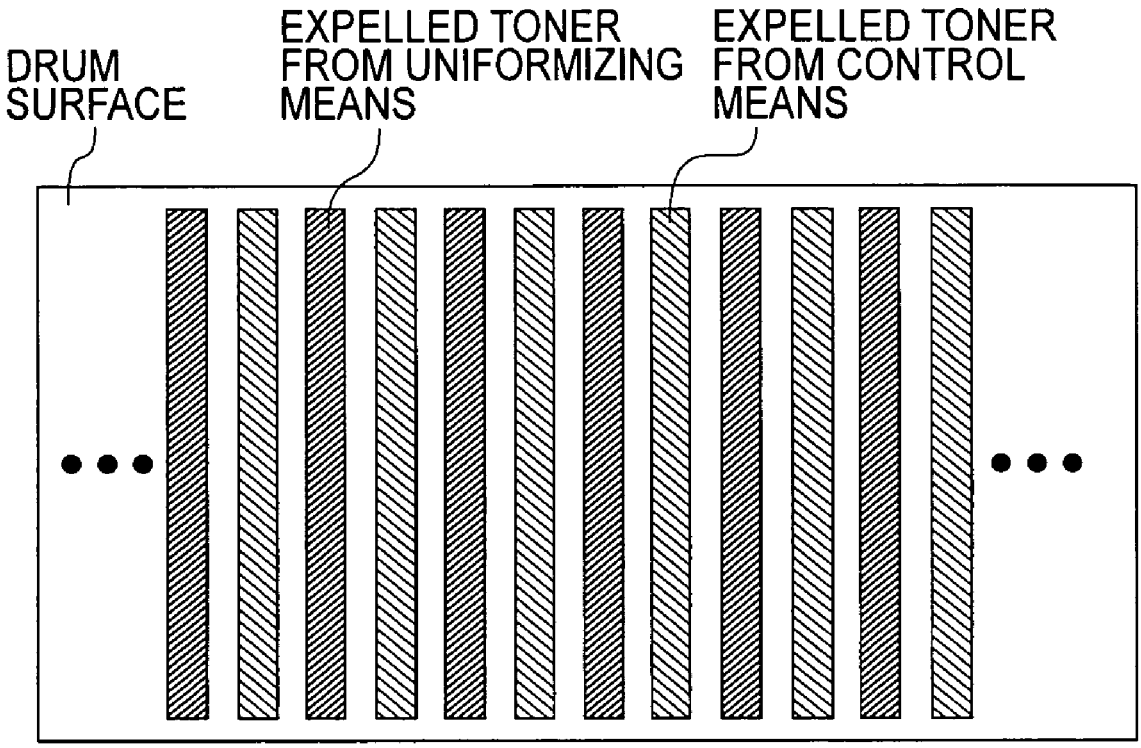
FIG. 4 is a schematic view showing a state of toner expelled from the transfer residual toner uniformizing means and the toner charge amount control means onto a photosensitive drum.

Further, the timing of applying the pulse voltage to the transfer residual toner uniformizing means 7 does not overlap with that of applying the pulse voltage to the toner charge amount control means 8 on the photosensitive drum 1 as shown in FIG. 4. In other words, the pulse voltage applications to the transfer residual toner uniformizing means 7 and the toner charge amount control means 8 are alternately performed. This is because it is possible to prevent the toner, expelled from the transfer residual toner uniformizing means 7 by application of the pulse voltage, from being again deposited on the toner charge amount control means 8.

Next, a mechanism of the expulsion of the toner, accumulated in the transfer residual toner uniformizing means 7 and the toner charge amount control means 8, on the photosensitive drum 1 by the expulsion control will be described.

Figure 5A:
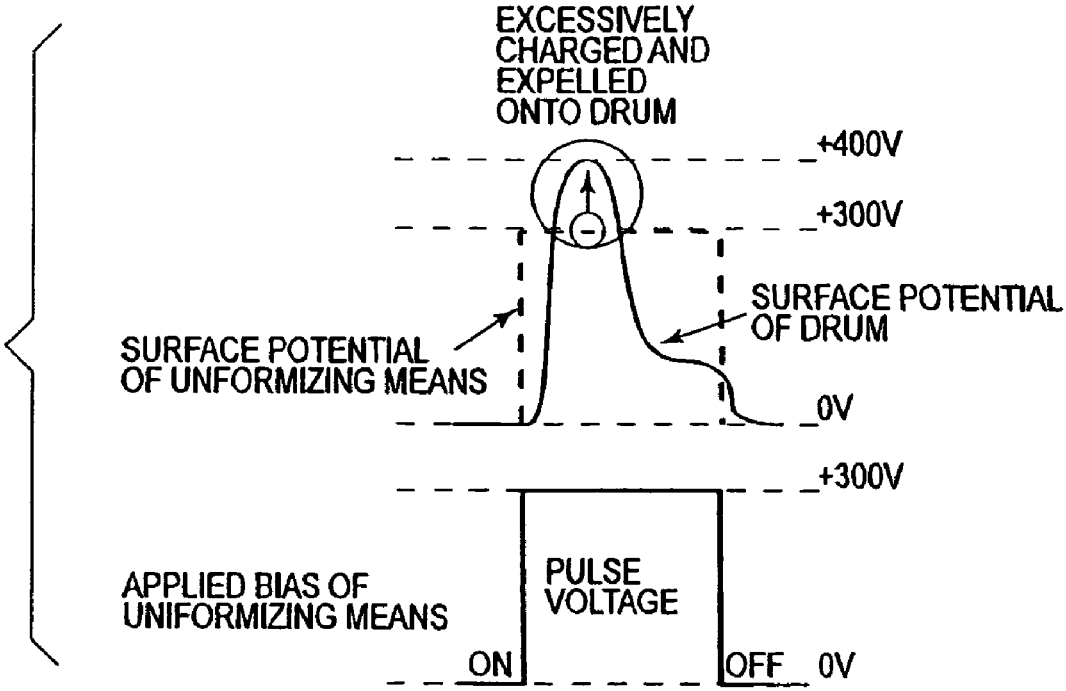
FIG. 5(*a*) is a schematic view for illustrating a relationship between surface potentials of the transfer residual toner uniformizing means and the photosensitive drum, and FIG. 5(*b*) is a schematic view for illustrating a relationship between surface potentials of the toner charge amount control means and the photosensitive drum.
Figure 5B:
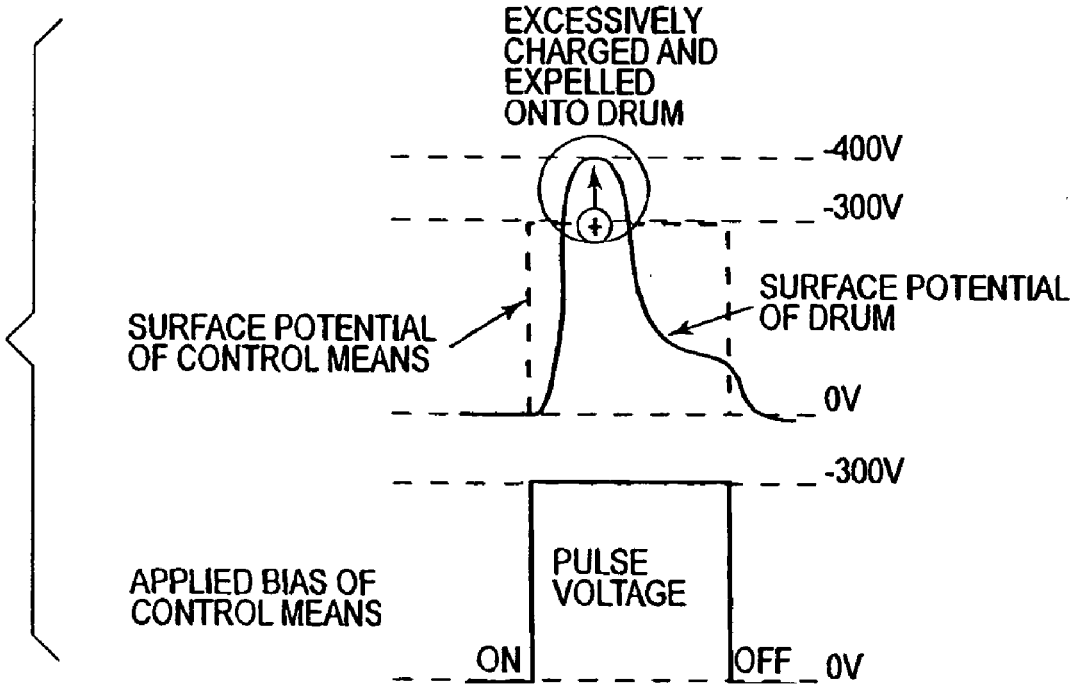

FIGS. 5(*a*) and 5(*b*) are schematic views for illustrating an expulsion control mechanism. FIG. 5(*a*) illustrates the expulsion control mechanism with respect to the transfer residual toner uniformizing means 7. When a voltage of +300 V is applied to the transfer residual toner uniformizing means 7, a current larger than that in a stable state transiently flows from the transfer residual toner uniformizing means 7 to the photosensitive drum 1. A surface potential of the photosensitive drum 1 at a portion through which the transient current passes is also increased compared with that in the stable state. In this embodiment, as shown in FIG. 5(*a*), the surface potential is about +400 V. More specifically, the surface potential of the transfer residual toner uniformizing means 7 at a portion contacting the photosensitive drum 1 is +300 V equal to the applied voltage and the surface potential of the photosensitive drum 1 at the portion through which the transient current passes is +400 V. To the transfer residual toner uniformizing means 7, the positive-polarity voltage is applied and the negative-polarity toner of the transfer residual toner is principally accumulated in the transfer residual toner uniformizing means 7. As a result, at such a timing of passage of transient current that the surface potential of the transfer residual toner uniformizing means 7 and the surface potential of the photosensitive drum 1 are reversed, the accumulated negative-polarity toner is expelled to the photosensitive drum 1. In a similar mechanism, with respect to also the expulsion control of the toner charge amount control means 8 shown in FIG. 5(*b*), the transfer residual toner of the positive polarity accumulated in the toner charge amount control means 8 is expelled.

Figure 6:
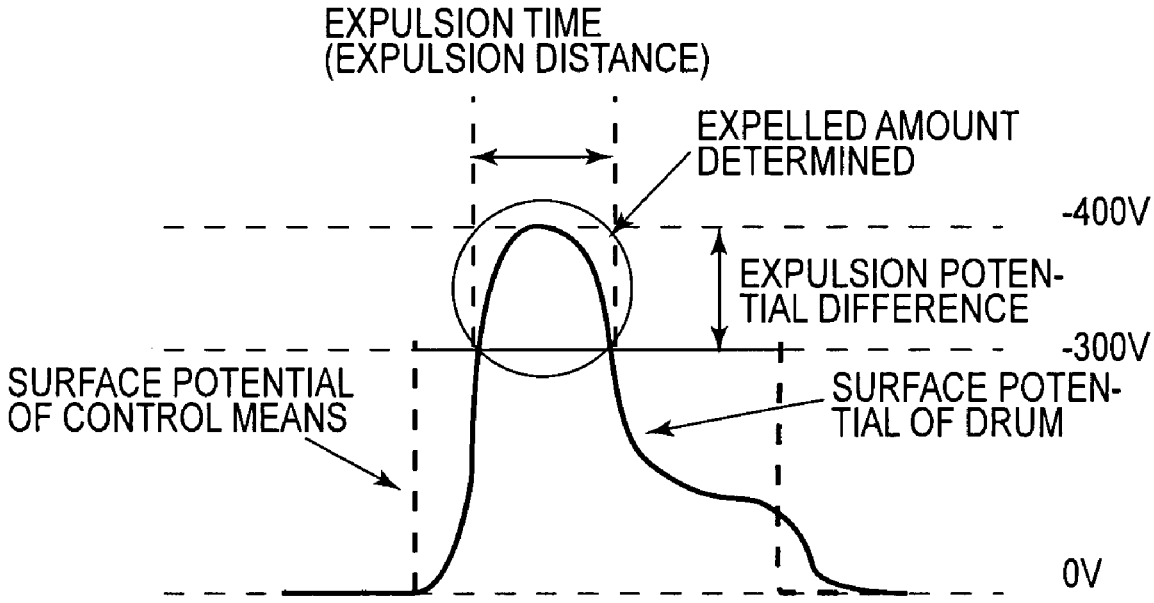
FIG. 6 is a schematic view for illustrating a relationship between an expulsion time and an expulsion potential difference.

Here, when the expulsion control is performed, an amount of expulsion of the accumulated toner from the toner charge amount control means 8 is, as shown in FIG. 6, determined by a period of time in which the surface potential of the toner charge amount control means 8 and the photosensitive drum 1 are reversed (exactly, the expulsion amount is larger with a longer movement distance of the photosensitive drum (hereinafter referred to as "expulsion time (expulsion distance)") and a potential difference between the surface potentials of the toner charge amount control means 8 and the photosensitive drum 1 (hereinafter, referred to as "expulsion potential difference"; a larger expulsion potential difference provides a large expulsion amount). When influences of the expulsion time and the expulsion potential difference on the expulsion amount are compared, the influence of the expulsion potential difference is large. This is true for the expulsion amount of the accumulated toner from the transfer residual toner uniformizing means 7.

Further, as described above, the expulsion of the transfer residual toner utilizes the transient current at the time when the voltage is applied to the transfer residual toner uniformizing means 7 and the toner charge amount control means 8, so that the expulsion amount is larger as the number of application of the pulse voltage to the transfer residual toner uniformizing means 7 and the toner charge amount control means 8 is increased.

(4) Expulsion Control of Toner from Auxiliary Charging Member Based on Image Print Ratio However, in the case where a continuous printing operation (continuous image forming operation) of an image having a very high print ratio is performed, a large amount of transfer residual toner can be accumulated in the transfer residual toner uniformizing means 7 and the toner charge amount control means 8 before a preliminarily determined expulsion control is performed (at an interval between continuous printing operations on 100-th sheet and 101-th sheet in this case). As a result, electrical resistances of the transfer residual toner uniformizing means 7 and the toner charge amount control means 8 are increased at the contact portions e and f (FIG. 1) between these means and the photosensitive drum 1, so that lowering in function of these means caused to occur to result in occurrences of charging failure, ghost, fog, etc.

Accordingly, in this embodiment, the print ratio of image is calculated on the basis of an amount of exposure of the exposure apparatus 3 as information writing means, and when an integrated value of the calculated print ratio is not less than a certain value (referred to as an "expulsion threshold"), expulsion control is performed at an interval between consecutive printing operations.

Figure 7:
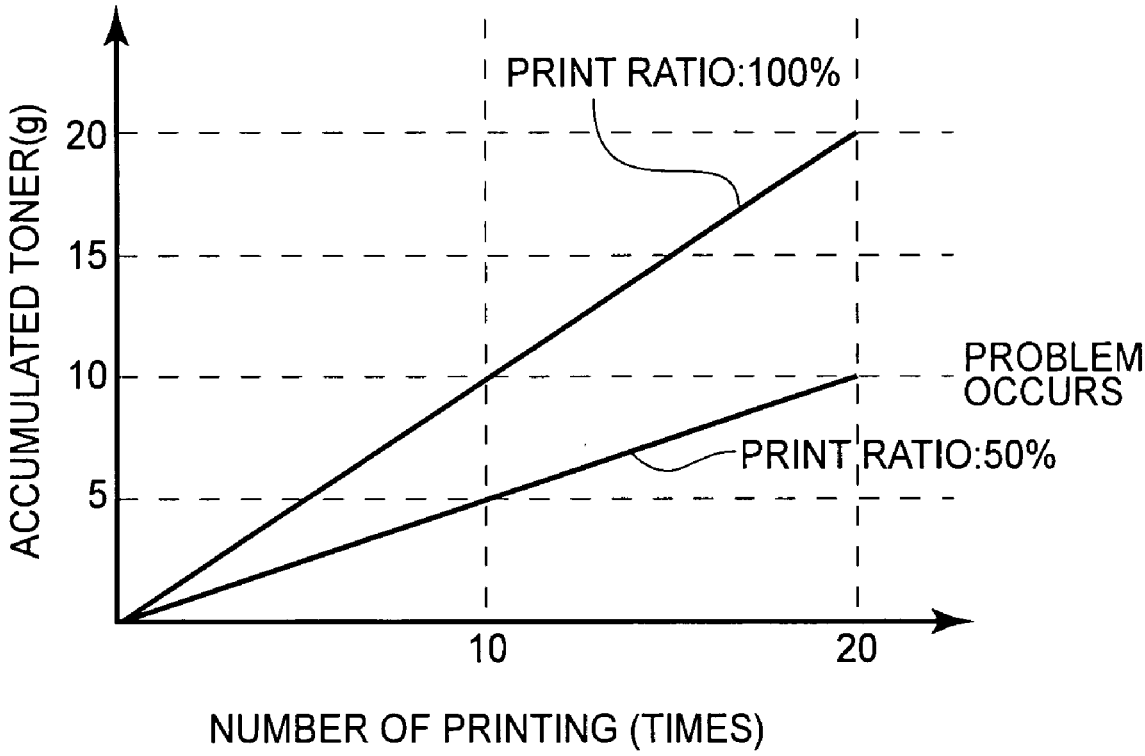
FIG. 7 is a graph showing a relationship between the number of printing operations and a total amount of accumulated transfer residual toner at different print ratios.

More specifically, a print ratio when an amount of exposure by the exposure apparatus 3 is maximum and the printing operation is performed in an entire A4-sized sheet (so-called solid black image) is defined as 100%. A value obtained by continuously performing a printing of 100% image 100 times, i.e., 100%×10 (times)=1000%, is taken as an expulsion threshold in this embodiment. The expulsion threshold is determined, as shown in FIG. 7, by such a phenomenon that an amount of transfer residual toner accumulated in the transfer residual toner uniformizing means 7 and the toner charge amount control means 8 exceeds an amount at which a problem occurs when 100% image is printed continuously 10 times on the basis of a relationship between a total amount of transfer residual toner accumulated in the transfer residual toner uniformizing means 7 and the toner charge amount control means 8 and occurrences of problems of charging failure, ghost, fogs, etc.

Here, as shown in FIG. 1, the image forming apparatus includes an arithmetic circuitry (CPU) 10 having a memory capable of writing and reading any number of times. The arithmetic circuitry 10 is connected to the power source S4 for applying a voltage to the transfer residual toner uniformizing means 7 and the power source S5 for applying a voltage to the toner charge amount control means 8.

In this embodiment, in the case of performing the continuous printing operation, the expulsion control is performed at an interval between printing operations on 100-th sheet and 101-th sheet when the print ratio is 10%, is performed at an interval between printing operation on 20-th sheet and 21-th sheet when the print ratio is 50%, and is performed at an interval between printing operation on 10-th sheet and 11-th sheet when the print ratio is 100%.

The timings at which the expulsion control is performed on the basis of the print ratio and the number of printing (times) but the present invention is not limited thereto. For example, the print ratio area the number of printing, i.e., the expulsion threshold can be arbitrarily set by a service person on an operation panel (not shown) of the image forming apparatus 100.

Further, in this embodiment, in the case where charging failure, ghost, fog, or the like is caused to occur during image formation, a user can perform the expulsion control at any timing. More specifically, a switch for performing the expulsion control is provided in the operation panel of the image forming apparatus 100, so that the user can perform the expulsion control in the case where the user judges that there is a problem when the user observes the resultant image.

As described above, by changing the timing of performing the expulsion control depending on the print ratio of image, it is possible to well expel the transfer residual toner accumulated in the transfer residual toner uniformizing means 7 and the toner charge amount control means 8 by the expulsion control even when a high print ratio image is continuously printed.

(5) Expulsion Control of Toner from Auxiliary Charging Member Based on Environment Depending on an environment in which the image forming apparatus 100 is used, electrical resistances of the transfer residual toner uniformizing means 7, the toner charge amount control means 8, and the photosensitive drum 1 are changed. For this reason, transient currents flowing from the transfer residual toner uniformizing means 7 and the toner charge amount control means 8 into the photosensitive drum 1 when the pulse voltage is applied to the means 7 and 8 are changed. More specifically, in a high humidity environment, the transient current is liable to flow and in a low humidity environment, the transient current is less liable to flow. For this reason, the expulsion time and the expulsion potential difference for determining the expulsion toner amount described with reference to FIG. 6 are changed, so that an amount of transfer residual toner expelled by one pulse voltage application is also changed.

Figure 8A:
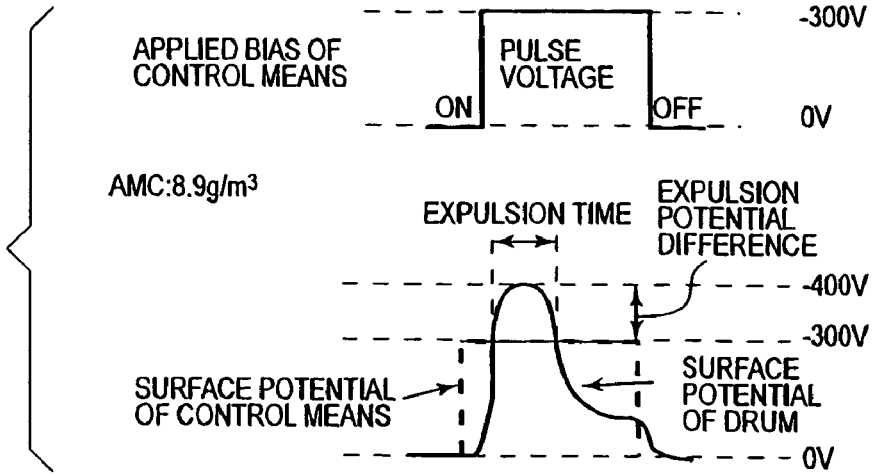
FIGS. 8(*a*), 8(*b*) and 8(*c*) are schematic view for illustrating a relationship between surface potentials of the toner charge amount control means and the photosensitive drum at different absolute moisture contents.
Figure 8B:
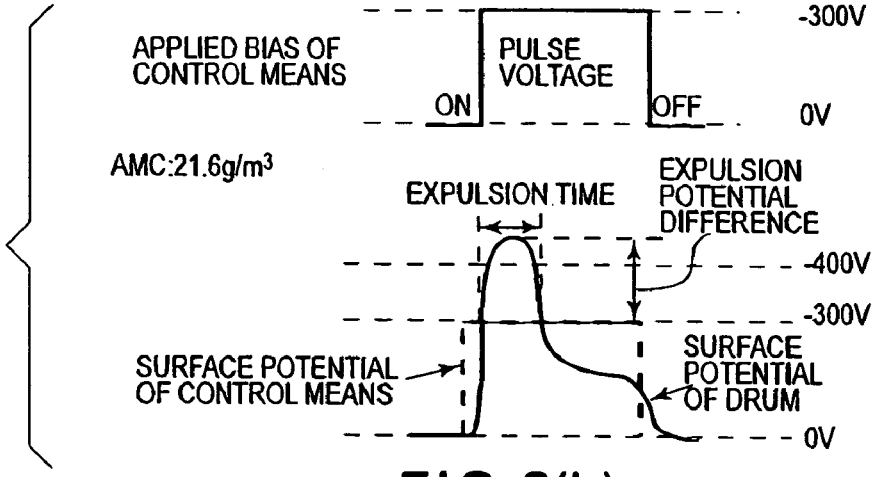

FIGS. 8(*a*), 8(*b*) and 8(*c*) are schematic views each showing a change in expulsion time and expulsion potential difference of the toner charge amount control means 8 depending on an absolute moisture content (AMC) in an environment in which the image forming apparatus 100 is used. An absolute moisture content of 8.9 g/m$^3$ shown in FIG. 6(*a*) is an normal (ordinary) moisture content.

As shown in FIG. 8(*b*), in the case of a high absolute moisture content of 21.6 g/m$^3$, the transient current flowing from the toner charge amount control means 8 into the photosensitive drum 1 is large, so that an expulsion potential difference is increased when compared with the case of a low absolute moisture content. On the other hand, an expulsion time is shortened since followability between the surface potentials of the toner charge amount control means 8 and the photosensitive drum 1 is improved.

Figure 8C:
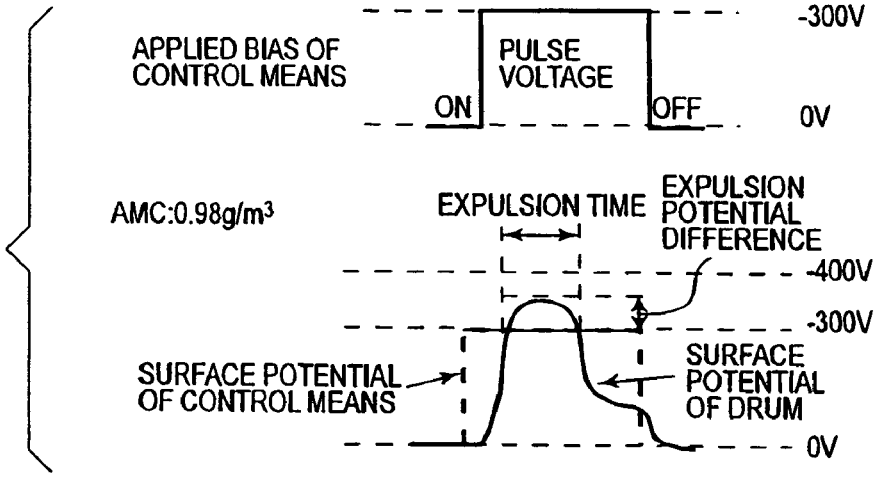

As shown in FIG. 8(C), in the case of a low absolute moisture content of 0.9 g/m$^3$, the transient current flowing from the toner charge amount control means 8 into the photosensitive drum 1 is small, so that an expulsion potential difference is decreased when compared with the case of a low absolute moisture content. On the other hand, an expulsion time becomes long since followability between the surface potentials of the toner charge amount control means 8 and the photosensitive drum 1 is poor.

As described above, the expulsion toner amount is largely affected by the expulsion potential difference rather than the expulsion time, so that the expulsion toner amount is large when the absolute moisture content in the operation environment of the image forming apparatus 100 is high and is small when the absolute moisture content is low.

It is possible to consider that the pulse voltage for the expulsion control is increased in order to increase the expulsion potential difference. However, when the pulse voltage is not less than discharge start voltages of members used for the transfer residual toner uniformizing means 7 and the toner charge amount control means 8, followability between surface potentials of the transfer residual toner uniformizing means 7 and the photosensitive drum 1 is improved by the discharge. As a result, to the contrary, the expulsion potential difference is small.

Figure 9:
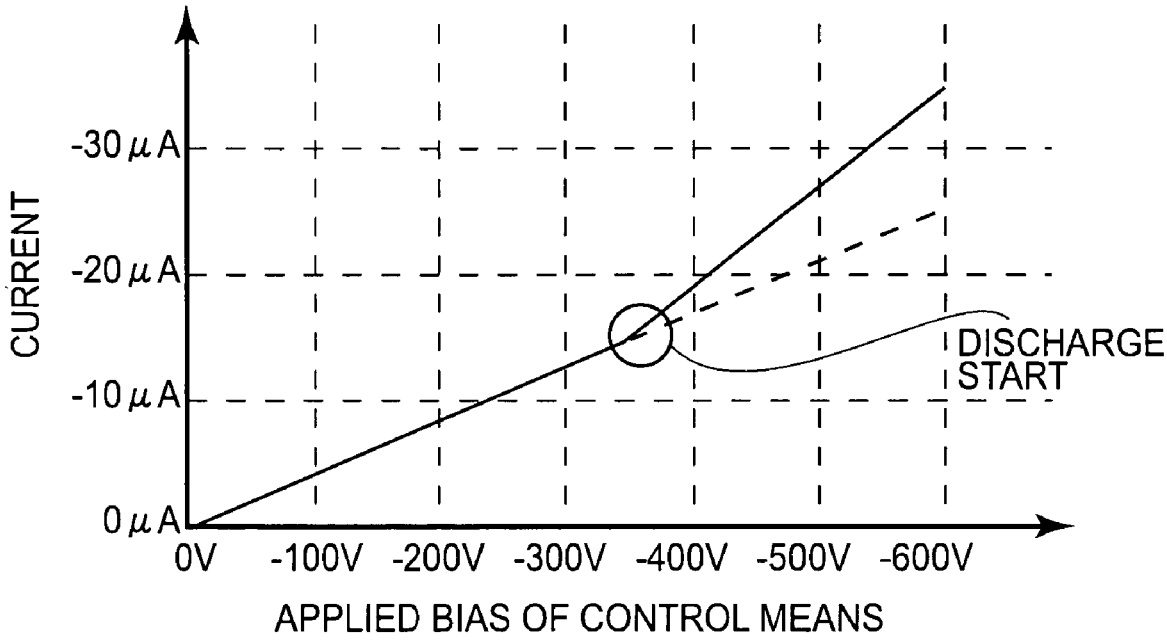
FIG. 9 is a graph showing a relationship between a voltage applied to the toner charge amount control means and a current passing through the photosensitive drum.
Figure 10A:
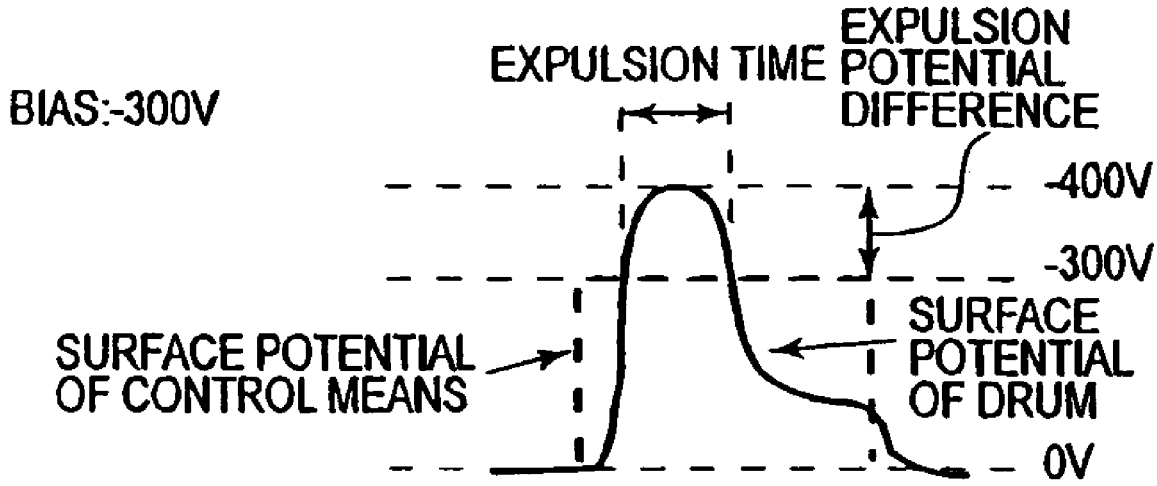
FIGS. 10(*a*) and 10(*b*) are schematic views for illustrating a relationship between surface potentials of the toner charge amount control means and the photosensitive drum at different applied biases.
Figure 10B:
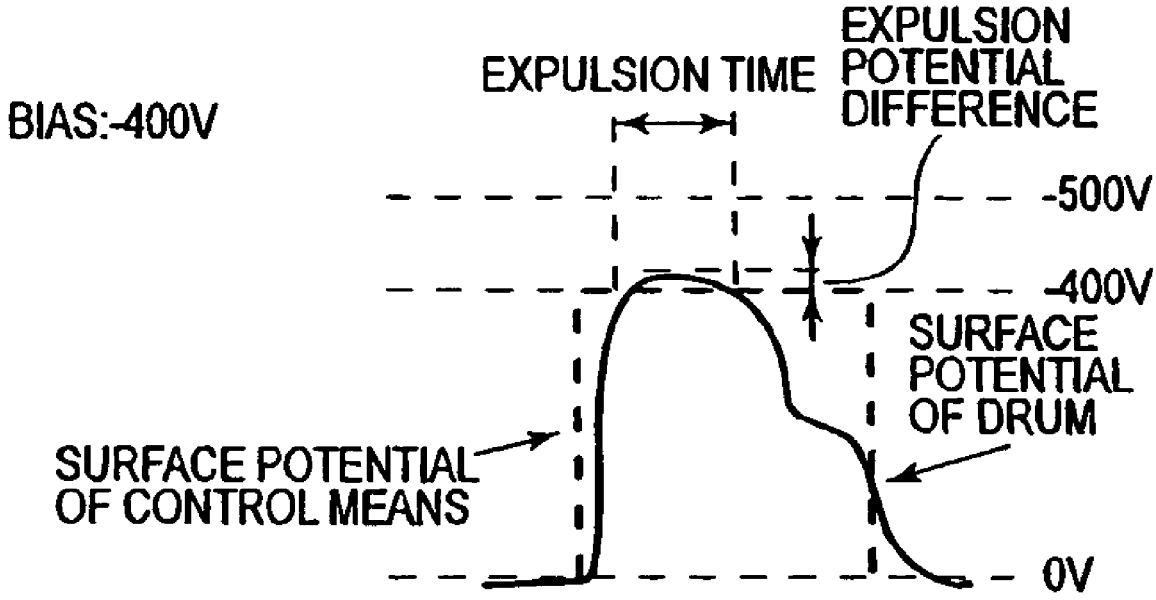

FIG. 9 is a graph showing a relationship between an applied voltage (applied bias voltage: abscissa) to the toner charge amount control means 8 used in this embodiment and a current (ordinate) passing through the photosensitive drum 1. From FIG. 9, it is found that the discharge starts at a voltage of about −350 V or above (absolute value). Further, FIGS. 10(*a*) and 10(*b*) are schematic views showing relationships between the surface potentials of the toner charge amount control means 8 and the photosensitive drum 1 when the voltage applied to the toner charge amount control means 8 is set to −300 V (FIG. 10(*a*)) and −400 V (FIG. 10(*b*)), respectively. From these figures, it is found that the expulsion potential difference at −400 V after the discharge is smaller than that at −300 V before the discharge.

In this embodiment, as shown in FIG. 1, an environmental sensor 11 for detecting temperature and humidity is provided and depending on an absolute moisture content calculated by the arithmetic circuitry 10 on the basis of detected temperature and humidity by the environmental sensor 11, such a control that the number of application of the pulse voltage applied during the expulsion control is changed is performed.

Figure 11:
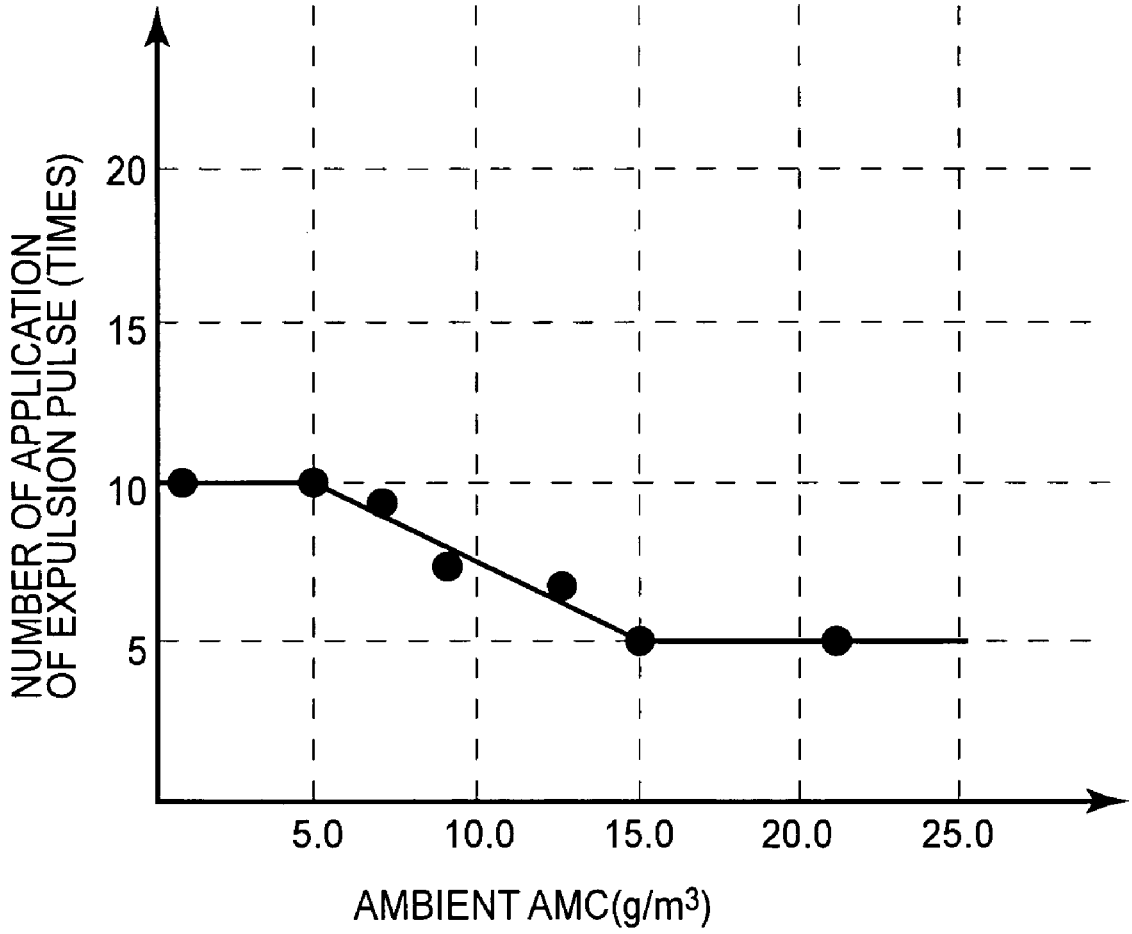
FIG. 11 is a graph showing a relationship between an operation environment (absolute moisture content) and the number of application of expulsion pulse.

FIG. 11 is a graph showing a relationship between an absolute moisture content in the operation environment of the image forming apparatus 100 and the number of application of expulsion pulse voltage (the number of application of the pulse voltage applied during the expulsion control). In the case where the absolute moisture content is less than 5.0 g/m$^3$, it is necessary to apply the pulse voltage ten times in order to expel all the transfer residual toner accumulated in the transfer residual toner uniformizing means 7 and the toner charge amount control means 8. On the other hand, in the case where the absolute moisture content is more than 15.0 g/m$^3$, it is only necessary to apply the pulse voltage five times in order to expel all the transfer residual toner accumulated in the transfer residual toner uniformizing means 7 and the toner charge amount control means 8. Incidentally, in all the environments, the pulse voltage may be applied ten times. In this case, however, a lowering in productivity of the image forming apparatus 100 is caused to occur due to a long time of expulsion control. For this reason, the number of application of the pulse voltage may preferably be requisite minimum.

Further, as a method of achieving the same effect as in the case of changing the number of application of the pulse voltage depending on the operation environment (absolute moisture content) of the image forming apparatus 100, it is also possible to employ the same method as that in the case where the timing of performing the expulsion control is changed depending on the print ratio of image. More specifically, the method is one wherein when the timing of performing the expulsion control at an absolute moisture content of 8.9 g/m$^3$ is after 100 times of printing operation, the timing of expulsion control in an environment of a low absolute moisture content of 0.9 g/m$^3$ is changed to a timing after 50 times of printing operation. However, in the case of using this method, particularly in a low humidity environment, a frequency of expulsion control interrupting the printing operation is very large, so that a considerably lowering in productivity of the image forming apparatus 100 is undesirably caused to occur.

As described above, depending on the operation environment (absolute moisture content) of the image forming apparatus 100, the number of application of the pulse voltage is changed. As a result, even when the image forming apparatus 100 is used in any environment, it is possible to well expel the transfer residual toner accumulated in the transfer residual toner uniformizing means 7 and the toner charge amount control means 8.

(6) Expulsion Control of Toner from Auxiliary Charging Member Based on Usage

Figure 12:
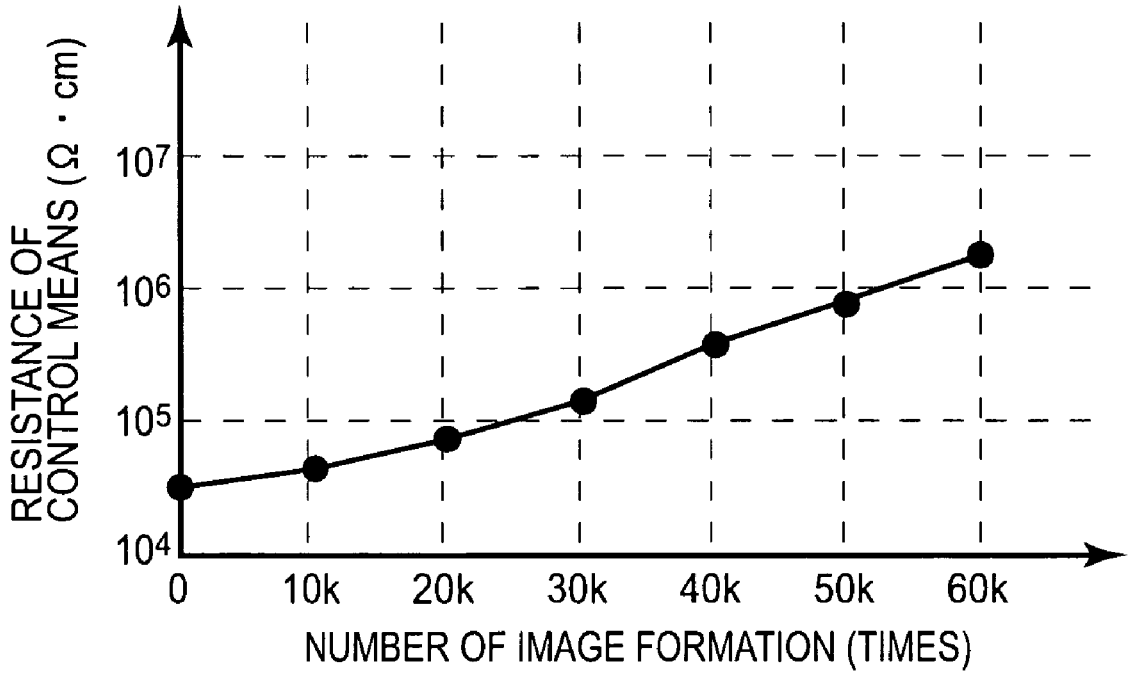
FIG. 12 is a graph showing a relationship between the number of image formation and an electrical resistance of the toner charge amount control means.

Electrical resistances of the transfer residual toner uniformizing means 7, the toner charge amount control means 8, and the photosensitive drum 1 are gradually increased as the image forming apparatus is used, so that transient currents flowing from the transfer residual toner uniformizing means 7 and the toner charge amount control means 8 into the photosensitive drum 1 are gradually decreased. FIG. 12 shows a relationship between the number of application of image formation (in terms of an integrated value from an initial stage) and an electrical resistance (volume resistivity) of the toner charge amount control means 8. As shown in FIG. 12, with an increase in number of image formation, the electrical resistance of the toner charge amount control means 8 is increased. For this reason, the expulsion time and the expulsion potential difference for determining the expulsion toner amount described with reference to FIG. 6 are changed depending on an amount of usage of the image forming apparatus 100. As a result, an amount of transfer residual toner expelled by one pulse voltage application is gradually decreased.

Figure 13A:
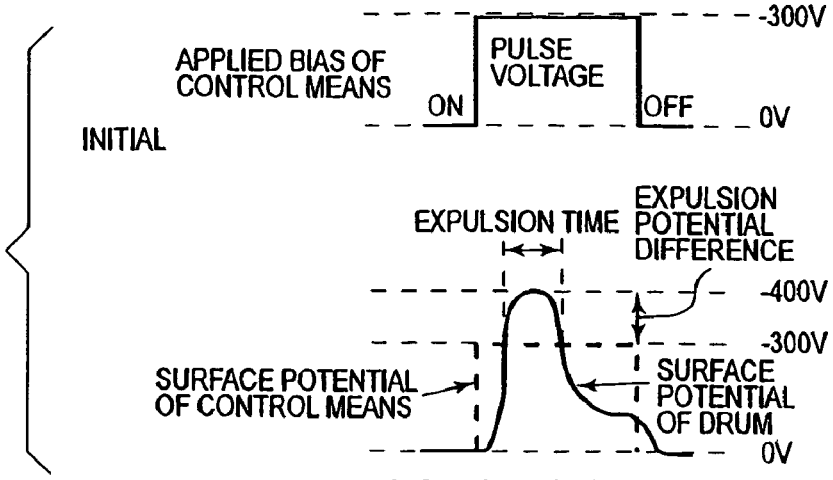
FIGS. 13(*a*), 13(*b*) and 13(*c*) are schematic views for illustrating a relationship between surface potentials of the toner charge amount control means and the photosensitive drum at different numbers of image formation.
Figure 13B:
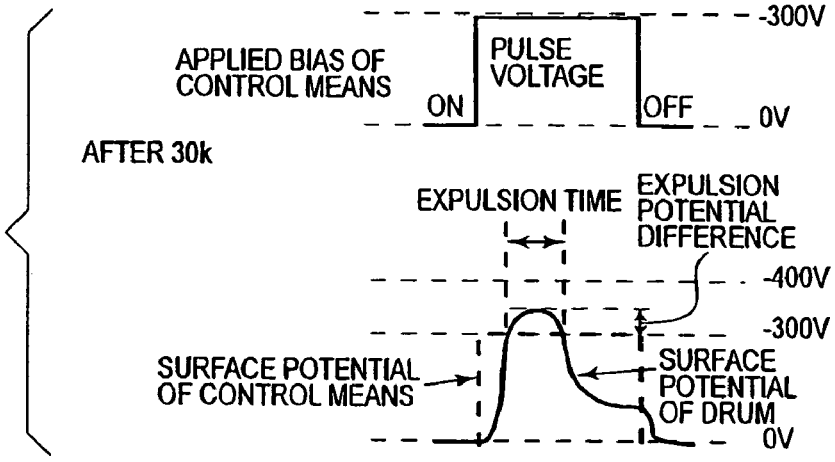
Figure 13C:
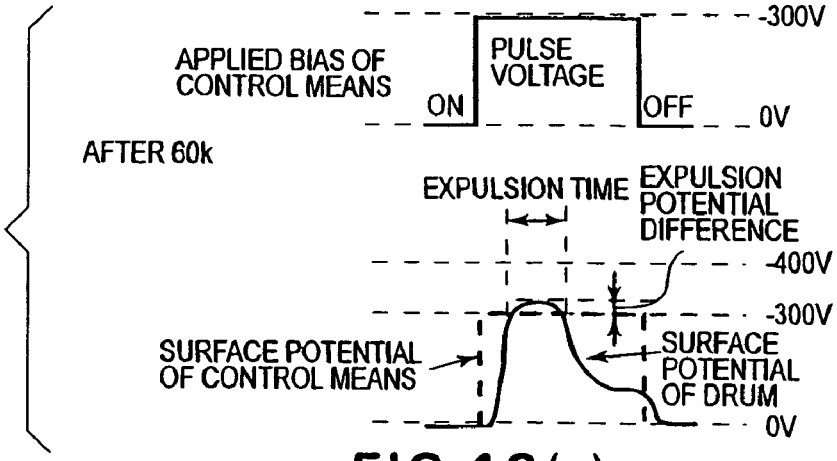

FIGS. 13(*a*), 13(*b*) and 13(*c*) are schematic views each showing a change in expulsion time and expulsion potential difference of the toner charge amount control means 8 depending on an amount of usage of the image forming apparatus 100 (the number of integral of printing operation), wherein FIG. 13(*a*) shows the case of printing operation at an initial stage, FIG. 13(*b*) shows the case of printing operation after 30 k (30,000) times, and FIG. 13(*c*) shows the case of printing operation after 60 k (60,000) times.

Figure 14:
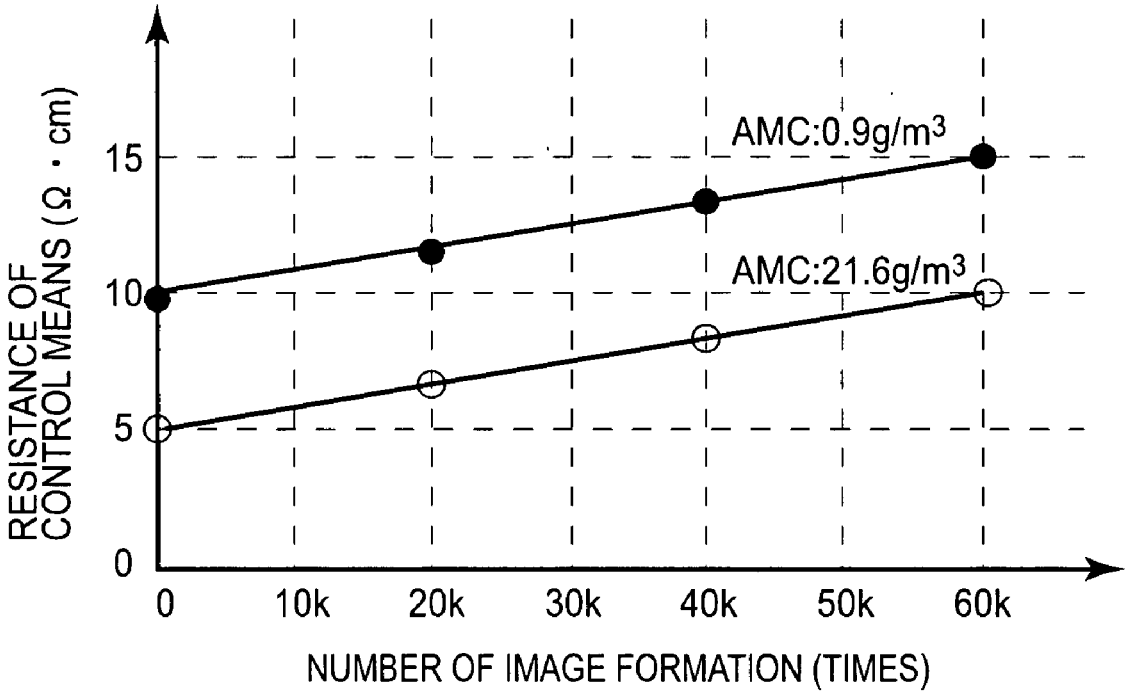
FIG. 14 is a graph showing a relationship between the number of image formation and an electrical resistance of the toner charge amount control means at different absolute moisture contents.

As shown in FIGS. 13(*a*), 13(*b*) and 13(*c*), as the number of integral of printing operation is increased to 60 k times through 30 k times, it is found that the expulsion potential difference is gradually decreased. This is because the electrical resistance of the toner charge amount control means 8 is gradually increased with an increasing number of integral of image formation (printing) operation (FIG. 12) and the transient current flowing from the toner charge amount control means 8 into the photosensitive drum 1 is decreased with the increasing number of integral of printing operation. As a result, the expulsion amount of the transfer residual toner accumulated in the toner charge amount control means 8 is also gradually decreased. Incidentally, this phenomenon has a similar tendency irrespective of an ambient absolute moisture content as shown in FIG. 14.

In this embodiment, such a control that the amount of usage of the image forming apparatus 100 such as the number of integral of printing operation is stored in a memory provided to the arithmetic circuitry 10 and the number of application of the pulse voltage during the expulsion control is increased with an increase in number of integral of printing operation is performed. As information on the amount of usage, it is also possible to use the number of relation of the photosensitive drum 1, as integrated value of application time of AC voltage or DC voltage applied to the charge roller 2, an integrated value of application time of DC voltage applied to the toner charge amount control means 8, and the like.

Figure 15:
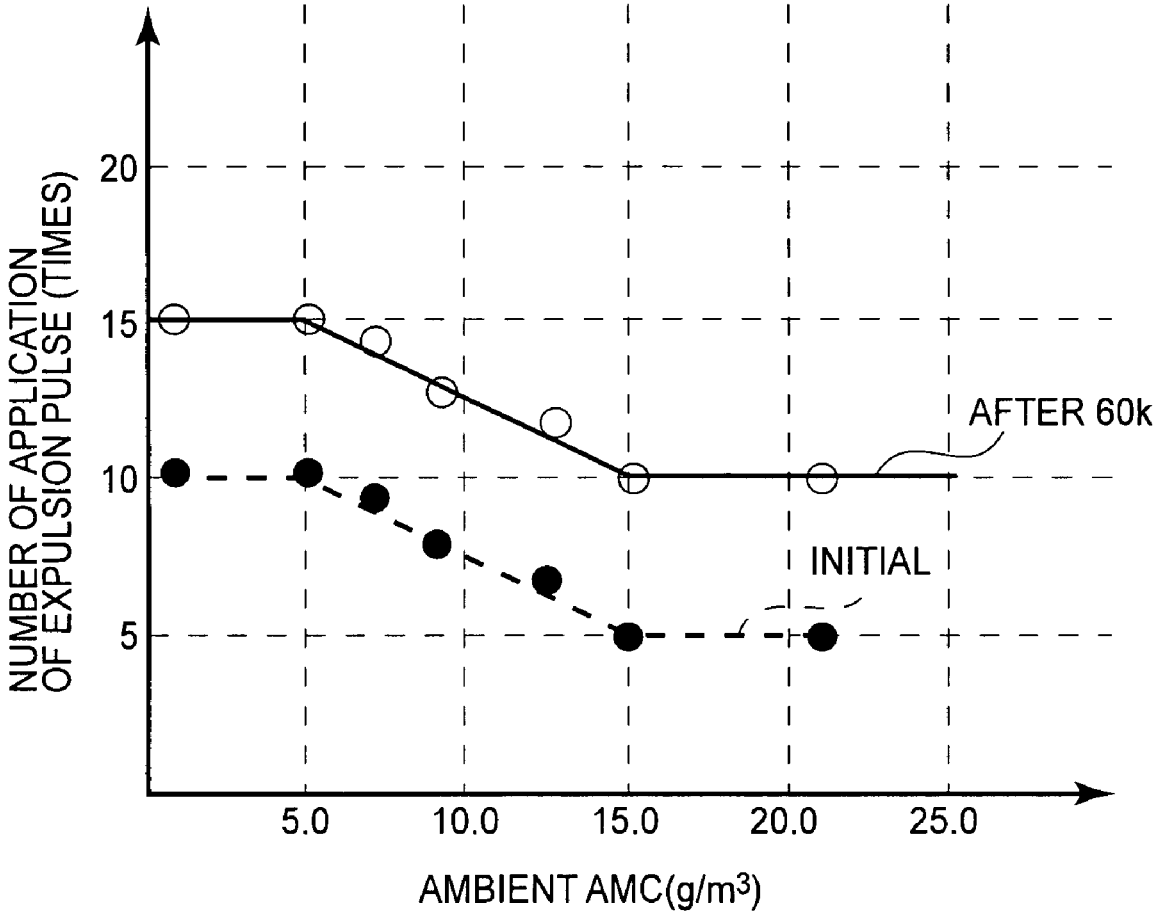
FIG. 15 is a graph showing a relationship between an absolute moisture content and the number of application of expulsion pulse at different numbers of image formation operations.
Figure 16:
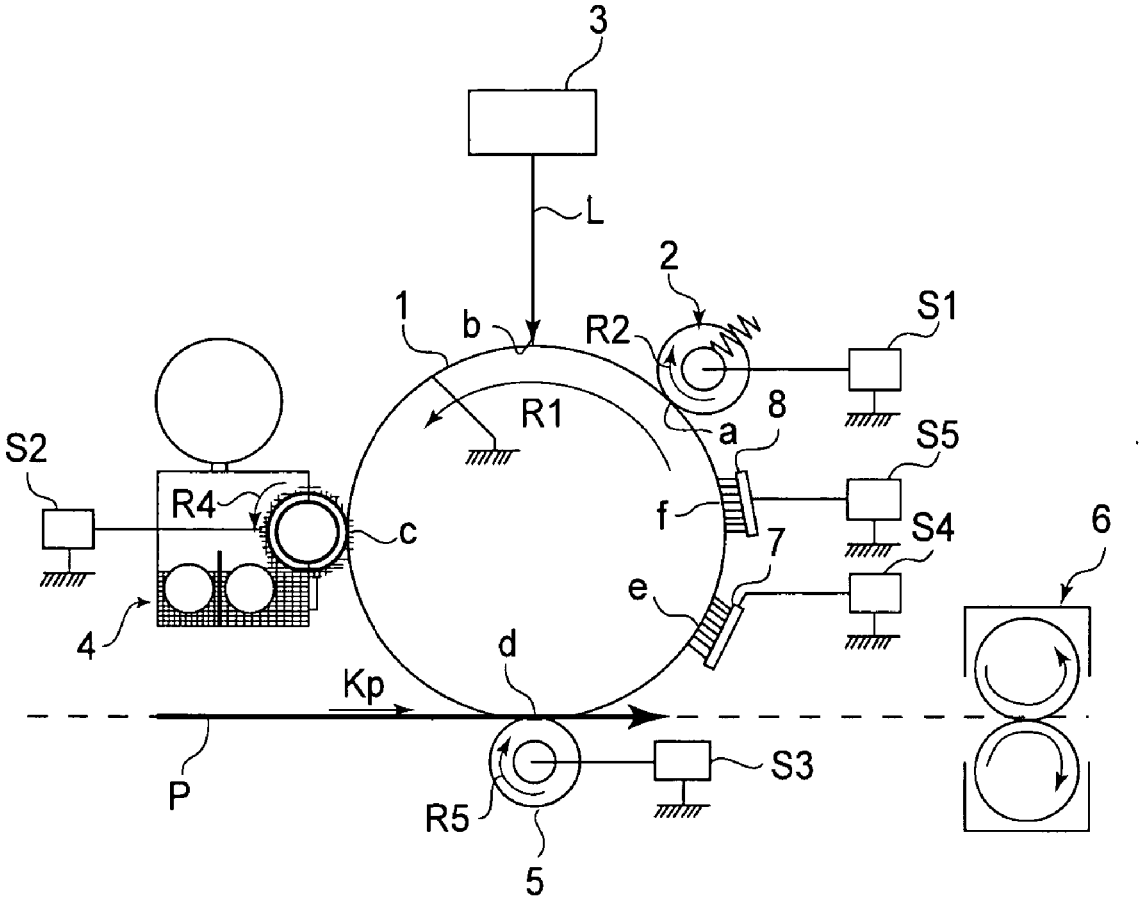

FIG. 15 is a graph showing a relationship between an operation environment (absolute moisture content) of the image forming apparatus 100 and the number of application of the pulse voltage when the number of integral of printing operation is those of an initial stage and after 60 k times. For example, when the absolute moisture content is 5.0 g/m$^3$, such a control that the number of pulse voltage application is 10 times at the initial stage but is 15 times after 60 k times of printing operation is performed. In an intermediary printing operation between the initial printing operation and the printing operation after 60 k times, the number of pulse voltage application is increased in steps depending on the number of integral of printing operation.

Further, as a method of achieving the same effect as in the case of changing the number of application of the pulse voltage depending on the number of integral of printing operation by the image forming apparatus 100, it is also possible to employ the same method as that in the case where the timing of performing the expulsion control is changed depending on the print ratio of image. More specifically, the method is one wherein when the timing of performing the expulsion control at the initial stage is after 100 times of printing operation, the timing of expulsion control when the number of integral of printing operation is changed to a timing after 50 times of printing operation. However, in the case of using this method, particularly in the case where the number of integral of printing operation is increased, a frequency of expulsion control interrupting the printing operation is very large, so that a considerably lowering in productivity of the image forming apparatus 100 is undesirably caused to occur.

As described above, depending on the amount of usage (the number of integral of printing operation) of the image forming apparatus 100, the number of application of the pulse voltage is changed. As a result, it is possible to well expel the transfer residual toner accumulated in the transfer residual toner uniformizing means 7 and the toner charge amount control means 8 for a long period of time.

In the above description, the case of using the charge roller 2 in a roller shape as the contact charging member is described as an example, but the present invention is not restricted thereto. Instead of the charge roller 2, it is possible to achieve the same effect as the charge roller 2 even when a charging blade on a magnetic brush is used.

Further, in the above description, the case of directly transferring a toner image formed on the photosensitive drum 1 onto the transfer material P as another member is described as an example. However, as another member, it is also possible to use an intermediary transfer member, such as an intermediary transfer belt or an intermediary transfer drum. By doing so, the present invention is also applicable to multi-color image forming apparatus capable of forming an image with a plurality of color toners.

Further, in the above description, the case of the image forming apparatus including two auxiliary charging members, i.e., the transfer residual toner uniformizing means 7 and the toner charge amount control means 8 is described as an example, but the present invention also applicable to image forming apparatuses including one of them and even in such a case, a similar effect can be achieved.

According to the present invention, in the cleaner-less type image forming apparatus, the control means changes the number of application of pulse-like DC voltage applied from a power source to an auxiliary charging member on the basis of an output of an environmental sensor, a usage detection means, or a print ratio detection means. As a result, even when the environment, the amount of usage, or the print ratio is changed, it is possible to sufficiently expel the transfer residual toner deposited and accumulated in the auxiliary charging member. Therefore, the charging process by the charging member can be well performed to effectively prevent charging failure (poor charging), ghost, fog, etc.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 362074/2004 filed Dec. 14, 2004, which is hereby incorporated by reference.

What is claimed is:

1. An image forming apparatus, comprising:

an image bearing member;

a contact charging member, disposed in contact with a surface of said image bearing member; for electrically charging said image bearing member;

exposure means for exposing the surface of said image bearing member, after being electrically charged, to light to form an electrostatic latent image;

developing means for developing the electrostatic latent image with toner to form a toner image and recovering toner remaining on said image bearing member;

transfer means for transferring the toner image from said image bearing member onto another member;

an auxiliary charging member, for processing the toner remaining on said image bearing member, disposed downstream from said transfer means and upstream from said contact charging member in a movement direction of the surface of said image bearing member;

voltage application means for applying a pulse-like direct-current voltage to said auxiliary charging member so as to expel the toner deposited on said auxiliary charging member from said auxiliary charging member onto said image bearing member;

control means for controlling said voltage application means; and an environmental sensor for detecting an ambient environment in which said image forming apparatus is set;

wherein said control means changes the number of times the pulse-like direct-current voltage is applied from said voltage application means to said auxiliary charging member on the basis of a detection result of said environmental sensor.

2. An apparatus according to claim 1, wherein said environment sensor is a temperature and humidity sensor for detecting a temperature and a humidity.

3. An apparatus according to claim 2, wherein said control means calculates an absolute moisture content in the ambient environment on the basis of a detection result of the temperature and humidity sensor and increases the number of times the pulse-like direct-current voltage is applied from said voltage application means to said auxiliary charging member with a decrease in absolute moisture content.

* * * * *

UNITED STATES PATENT AND TRADEMARK OFFICE

CERTIFICATE OF CORRECTION

PATENT NO. : 7,383,004 B2
APPLICATION NO. : 11/302421
DATED : June 3, 2008
INVENTOR(S) : Tadanobu Yoshikawa It is certified that error appears in the above-identified patent and that said Letters Patent is hereby corrected as shown below:

COLUMN 2
Line 18, “distribution” should read --distribution of--.

COLUMN 3
Line 62, “Particularly;” should read --Particularly,--.
Line 63, “above described” should read --above-described--.

COLUMN 4
Line 1, “above described” should read --above-described--.
Line 10, “above described” should read --above-described--.

COLUMN 6
Line 56, “nd” should read --and--.

COLUMN 8
Line 7, “above described” should read --above-described--.
Line 36, “THe” should read --The--.

COLUMN 10
Line 16, “above described” should read --above-described--.

COLUMN 11
Line 43, “preferably” should read --preferably be--.

UNITED STATES PATENT AND TRADEMARK OFFICE

CERTIFICATE OF CORRECTION

PATENT NO. : 7,383,004 B2
APPLICATION NO. : 11/302421
DATED : June 3, 2008
INVENTOR(S) : Tadanobu Yoshikawa It is certified that error appears in the above-identified patent and that said Letters Patent is hereby corrected as shown below:

COLUMN 16

Line 32, "an" should read --a--.

Signed and Sealed this

Twenty-eighth Day of October, 2008

JON W. DUDAS
*Director of the United States Patent and Trademark Office*